US007537552B2

(12) United States Patent
Dalebout et al.

(10) Patent No.: US 7,537,552 B2
(45) **Date of Patent: *May 26, 2009**

(54) EXERCISE DEVICE WITH CENTRALLY MOUNTED RESISTANCE ROD AND AUTOMATIC WEIGHT SELECTOR APPARATUS

(75) Inventors: William T. Dalebout, North Logan, UT (US); Michael Olson, Logan, UT (US)

(73) Assignee: Icon IP, Inc. (State of Delaware), Logan, UT (US)

( * ) Notice: Subject to any disclaimer, the term of this patent is extended or adjusted under 35 U.S.C. 154(b) by 743 days.

This patent is subject to a terminal disclaimer.

(21) Appl. No.: 10/647,729

(22) Filed: Aug. 25, 2003

(65) Prior Publication Data

US 2005/0049121 A1 Mar. 3, 2005

(51) Int. Cl.
*A63B 21/04* (2006.01)
*A63B 21/02* (2006.01)

(52) U.S. Cl. ..... 482/129; 482/130; 482/121

(58) Field of Classification Search ..... 482/129–130, 482/139, 121–123, 100–103
See application file for complete search history.

(56) References Cited

U.S. PATENT DOCUMENTS

| | | | | |
|---|---|---|---|---|
| 9,695 | A | 5/1853 | Hinsdale | |
| 192,338 | A | 6/1877 | Marshall | |
| 325,435 | A | 9/1885 | North | 186/22 |
| 428,912 | A | 5/1890 | Holmes | |
| 484,352 | A | 10/1892 | Ayton | |
| 588,350 | A | 8/1897 | Perkins | |
| 610,716 | A | 9/1898 | Marshall | |
| 685,788 | A | 11/1901 | McFadden | |
| 754,992 | A | 3/1904 | Grabner | |
| 807,670 | A | 12/1905 | Grabner | |
| 852,193 | A | 4/1907 | McMillan | |

(Continued)

FOREIGN PATENT DOCUMENTS

| | | |
|---|---|---|
| DE | 23 46 105 | 3/1975 |

(Continued)

OTHER PUBLICATIONS

Breitbart Muscle Builder Apparatus, *Breitbard Pupils Say it with Muscles*!, May 4, 1929 (3 pages).

(Continued)

*Primary Examiner*—Fenn C Mathew
(74) *Attorney, Agent, or Firm*—Workman Nydegger

(57) ABSTRACT

An exercise apparatus with a single resistant rod configured to provide resistance for use in exercise and an electronic weight selector mechanism for use with a resistance rod having a variable resistance system and an electronic weight selector control. The variable resistance system includes a cable and pulley system that compounds the force exerted by the user on the cable and pulley system allowing the user a greater extension length per unit length the resistance rod is displaced. The variable resistance system includes a lever arm having an adjustable effective length to change the amount of resistance by changing the mechanical advantage provided by the lever arm. The electronic weight selector control including program exercise routines which assist the user in exercise by providing desired patterns, amounts of resistance, numbers of sets and repetitions, and combinations of exercises to be performed.

58 Claims, 13 Drawing Sheets

U.S. PATENT DOCUMENTS 964,745 A 7/1910 Blakoe
1,019,861 A 3/1912 Titus
1,115,826 A 11/1914 Johnson
1,123,272 A 1/1915 Goodman
1,144,085 A 6/1915 Abplanalp
1,495,278 A 5/1924 Titus
1,539,214 A 5/1925 Shockey
1,576,474 A 3/1926 Walker
1,585,748 A 5/1926 Wendelken
1,698,831 A 1/1929 Titus
2,346,105 A 4/1944 Haehnel ..... 66/127
2,456,017 A 12/1948 Park ..... 272/79
2,641,250 A 6/1953 Brockman
2,763,156 A 9/1956 Garigal ..... 73/381
D182,660 S 4/1958 Hastings ..... D34/5
2,843,858 A 7/1958 Bjorklund
2,855,200 A 10/1958 Blickman
2,968,337 A 1/1961 Bartlett ..... 155/18
3,000,628 A 9/1961 Kellogg ..... 269/205
3,342,485 A 9/1967 Gaul
3,370,584 A 2/1968 Girten
3,465,592 A 9/1969 Perrine ..... 73/379
3,567,219 A 3/1971 Foster
3,601,398 A 8/1971 Brochman ..... 273/26 E
3,638,941 A 2/1972 Kulkens ..... 272/83 R
3,640,528 A 2/1972 Proctor ..... 272/81
3,658,327 A 4/1972 Thiede
3,664,916 A 5/1972 Grellier et al.
3,690,655 A 9/1972 Chapman ..... 272/81
3,708,167 A 1/1973 Potgieter
3,797,624 A 3/1974 Powell et al.
3,858,874 A 1/1975 Weider ..... 272/79 R
3,884,464 A 5/1975 Evangelos ..... 272/79 R
3,891,207 A 6/1975 Helliwell
3,892,404 A 7/1975 Martucci ..... 272/79 R
3,918,710 A 11/1975 Niebojewski ..... 272/81
3,957,266 A 5/1976 Rice ..... 272/125
3,958,803 A 5/1976 Geisselbrecht ..... 272/135
3,981,500 A 9/1976 Ryan
4,026,548 A 5/1977 Birdwell ..... 272/136
4,063,727 A 12/1977 Hall
4,072,309 A 2/1978 Wilson ..... 272/136
4,074,409 A * 2/1978 Smith ..... 29/446
4,076,237 A 2/1978 Dussia ..... 272/136
4,082,267 A 4/1978 Flavell ..... 272/125
4,131,701 A 12/1978 VanAuken ..... 428/36
4,157,181 A 6/1979 Cecka ..... 273/80
4,207,879 A 6/1980 Safadago et al.
4,231,568 A 11/1980 Riley et al. ..... 272/136
4,263,897 A 4/1981 Terayama
4,307,880 A 12/1981 Abram ..... 272/146
4,316,609 A 2/1982 Silberman ..... 272/118
4,316,610 A 2/1982 Hinds ..... 272/137
4,328,965 A 5/1982 Hatfield ..... 272/137
4,334,678 A 6/1982 Doyel ..... 272/141
4,354,675 A 10/1982 Barclay et al.
4,355,061 A 10/1982 Zeigler ..... 428/36
4,384,715 A 5/1983 Savio et al. ..... 272/136
4,426,077 A 1/1984 Becker ..... 272/118
4,428,577 A 1/1984 Weingardt ..... 272/135
4,441,708 A 4/1984 Brentham ..... 272/130
4,465,276 A 8/1984 Cox ..... 272/137
4,494,662 A 1/1985 Clymer
4,521,013 A 6/1985 Dofel ..... 272/136
4,569,519 A 2/1986 Mattox et al.
4,603,855 A 8/1986 Sebelle ..... 272/117
4,603,856 A 8/1986 Fiore
4,608,969 A 9/1986 Hamlin
4,620,701 A 11/1986 Mojden
4,620,704 A * 11/1986 Shifferaw ..... 482/130
4,647,040 A 3/1987 Ehrenfried
4,685,670 A 8/1987 Zinkin ..... 272/136
4,721,303 A 1/1988 Fitzpatrick ..... 272/117
4,725,057 A 2/1988 Shifferaw
4,741,530 A 5/1988 Wolf
4,743,010 A 5/1988 Geraci
4,750,738 A 6/1988 Dang
4,756,527 A 7/1988 Ledbetter
4,772,015 A 9/1988 Carlson et al.
4,790,596 A 12/1988 Shifferaw
4,826,158 A 5/1989 Fields, Jr.
4,844,453 A 7/1989 Hestilow
4,877,239 A 10/1989 Dela Rosa
4,898,381 A 2/1990 Gordon ..... 272/117
4,907,795 A 3/1990 Shaw et al.
5,005,832 A 4/1991 Van Der Hoeven ..... 482/124
5,022,377 A * 6/1991 Stevens ..... 124/23.1
5,039,088 A 8/1991 Shifferaw
5,108,090 A 4/1992 Reed
5,123,886 A * 6/1992 Cook ..... 482/129
5,141,483 A 8/1992 Smith
5,151,071 A * 9/1992 Jain et al. ..... 482/101
5,176,601 A 1/1993 Reynolds
5,195,937 A 3/1993 Engel et al.
5,209,223 A 5/1993 McGorry et al.
5,211,617 A * 5/1993 Millen ..... 482/127
5,254,066 A * 10/1993 Brown et al. ..... 482/137
5,316,534 A 5/1994 Dalebout et al.
5,318,495 A 6/1994 Malynowsky
5,320,591 A 6/1994 Harmon et al.
5,330,405 A 7/1994 Habing et al.
5,421,801 A 6/1995 Davies, III et al. ..... 482/131
5,472,399 A 12/1995 Szekely ..... 482/121
5,480,212 A 1/1996 Marconet
5,529,560 A 6/1996 Davies, III et al. ..... 482/131
5,626,547 A 5/1997 Davies, III et al. ..... 482/131
5,895,342 A * 4/1999 Solland ..... 482/96
5,967,950 A 10/1999 Hsu ..... 482/96
6,003,294 A 12/1999 Fitzgerald et al.
6,011,134 A 1/2000 Marks et al.
6,027,429 A 2/2000 Daniels
6,082,346 A * 7/2000 Andrews et al. ..... 124/25.6
6,113,522 A * 9/2000 Fontenot et al. ..... 482/111
6,172,178 B1 1/2001 Koning et al.
6,217,495 B1 4/2001 Yalch
6,238,322 B1 5/2001 Hsu
6,238,323 B1 5/2001 Simonson
6,319,179 B1 11/2001 Hinds
6,335,100 B1 1/2002 Tominaga et al.
6,342,028 B1 1/2002 de Sane
6,585,626 B2 * 7/2003 McBride ..... 482/130
6,595,905 B2 7/2003 McBride ..... 482/130
6,685,607 B1 2/2004 Olson ..... 482/142
7,197,029 B1 3/2007 Osterhout et al.
7,250,022 B2 7/2007 Dalebout et al. ..... 482/142
2005/0143230 A1 6/2005 Dalebout et al. ..... 482/121
2006/0035768 A1 2/2006 Kowallis et al.

FOREIGN PATENT DOCUMENTS

DE 2810632 C3 1/1981
DE 32 31 228 2/1984
GB 5867 0/1913
GB 134847 1/1920
GB 325435 2/1930
GB 374240 6/1932
GB 496740 2/1937
GB 466901 6/1937
GB 841537 7/1960
GB 1 326 704 8/1973
JP 365694 6/1950
JP 55-148571 11/1980

WO WO 01/85262 11/2001

OTHER PUBLICATIONS

Marcy Gymnasium Equipment Co., *Physical Fitness Equipment for the Entire Family* (1 page).
Weider Barbell Co., *Giant Multiplex Builder* (1 page).
Canadiana, *Big 16* (1 page).
Broom Hall, *Broom's Advanced International Course* (1 page).
Verlag Athletik, *Universal Twister* (1 page).
RetroSearch, nerac.com, printed Jul. 2, 2004 (4 pages).
Advertisement for Breitbart Muscle Building Apparatus, *Breitbart Pupils Say it with Muscles!*, May 4, 1929 (3 pages).
Advertisement for Marcy Gymnasium Equipment Co., Physical Power publication, Apr. 1964 (1 page).
Advertisement for Weider's *Giant Multiplex Builder*, Muscle Power publication, Jan. 1949 (1 page).
Advertisement for Canadiana, *Big 16*, Body-Building publication, Feb. 1962 (1 page).
Advertisement for *Broom's Advanced International Course*, Superman publication, Dec. 1938 (1 page).
Advertisement for *Universal Twister* in Athletik Sport Journal (Holland), 1972 (1 page).
Inventor disclosure by Tessema Shifferaw relating to Ex-Stick I, available on information and belief at least as early as Sep. 1982 (5 pages).
Inventor disclosure by Tessema Shifferaw relating to Ex-Stick II, available on information and belief at an unknown date later than Sep. 1982 (1 page).
Office Action dated Mar. 23, 2007, 9 pages, U.S. Appl. No. 10/968,250.
Office Action dated Sep. 18, 2006, 11 pages, U.S. Appl. No. 10/968,250.
Response to Office Action dated Dec. 14, 2006, 25 pages, U.S. Appl. No. 10/968,250.
Response to Office Action dated Apr. 23, 2007, 25 pages, U.S. Appl. No. 10/968,250, with Terminal Disclaimer dated Apr. 23, 2007.
Notice of Allowance and Fee(s) Due, dated mailed Jul. 13, 2007, 7 pages, U.S. Appl. No. 10/968,250.
Notice of Allowance and Fee(s) Due, dated mailed Nov. 28, 2007, 7 pages, U.S. Appl. No. 10/968,250.
3422 Hall-Effect, Direction-Detection Sensor, Copyright 2001, 2003, Allegro MicroSystems, Inc. available online at www.allegomicro.com, p. 1-10.
A3425 Ultra-Sensitive Dual-Channel Quadrature Hall-Effect Bipolar Switch, Copyright 2005, Allegro MicroSystems, Inc. available online at www.allegromicro.com, p. 1-21.
Owner's Manual for Impex Fitness Products, *Powerhouse Home Gym WM 1400*, Revised Jun. 30, 2000.
Supplementary European Search Report dated May 9, 2008, from the European Patent Office, 6 pages.
MegaFitness.com, *Band Flex Home Gym*, printed Aug. 14, 2002, Copyright 1997-2002, 5 pgs.
LeonardFitness.com, *Bandflex Home Gym*, printed Aug. 14, 2002, Copyright 1999-2001, 4 pgs.
LeonardFitness.com, *Bowflex® Power Pro*, printied Aug. 20, 2002, Copyright 1999-2001, 3 pgs.
Website, www.bowflex.com, printed Sep. 17, 2002, 96 pgs.
Bowflex® Power Pro®, *Owner's Manual & Fitness Guide*, Copyright 2001, 80 pgs.
Bowflex® Power Pro®, *Assembly Manual*, Copyright 2000, 28 pgs.
*Lat Pulldown Attachment Assembly Instructions*, available, on information and belief, at least as early as Mar. 2002, 10 pgs.
Reviewboard.com, *Bowflex Power Pro XTLU*, printed Aug. 20, 2002, 2 pgs.
NickPicks.com, *As Seen on TV Bowflex*, printed Aug. 20, 2002, 3 pgs.
2002 Project Abstract (including "University of Wyoming Zero Gravity Construction"), printed Aug. 20, 2002, 9 pgs.
Bowflex Trainer, *Power Rod Resistance*, printed Aug 20, 2002, 1 pg.
Battle for the Best Pecs, printed Aug. 20, 2002, 3 pgs.
Soloflex.com, *Soloflex®, Compound Barbell*, printed Sep. 17, 2002, 1 pg.
Bowflex.com, *Get Results with a Blowlfex Home Gym*, printed Sep. 17, 2002, Copyright 2002, 2 pgs.
Notice of Allowance and Fee(s) Due dated Mar. 14, 2008, U.S. Appl. No. 10/968,250, 6 pages.

* cited by examiner

EXERCISE DEVICE WITH CENTRALLY MOUNTED RESISTANCE ROD AND AUTOMATIC WEIGHT SELECTOR APPARATUS

BACKGROUND OF THE INVENTION

1. The Field of the Invention

The present invention relates to exercise devices. More specifically, the present invention relates to an exercise device having a resilient member for providing resistance for use in exercise and having a weight selector apparatus.

2. Background and Relevant Technology

Society in general is becoming more health-conscious. A result of this has been an increased demand for fitness devices that can be utilized to attain and maintain healthy levels of fitness. Multi-function exercise machines have been developed in response to this demand. Multi-function exercise machines are often adapted to be convenient to operate and store, while still providing the range of exercises necessary to provide effective all around fitness.

One type of conventional multi-function exercise machine utilizes a stack of weights to provide resistance needed by users during exercise. A user repetitively raises some, or all, of the weights in the weight stack. The force of gravity provides the resistance needed to allow the user to exercise. However, due to the mass of the weights, these machines are heavy and can be difficult for a home user to move.

Exercise machines that use flexible members to provide resistance have been developed as an alternative to weight stack machines. One such device available in the market incorporates two sets of flexible rods of varying resistance. The bottom end of each set of rods is attached to the base of the machine with the rods extending vertically upwards therefrom. A cable is attached to the top end of each set of rods by means of a large hook that is threaded through loops at the top end of each rod. By bundling the rods in this manner, the user can adjust the amount of resistance used during exercise. By displacing the cables, a user can utilize the resistance provided by the flexible rods to exercise various muscle groups.

However, the manner in which the hook apparatus must be used to bundle the flexible rods together is awkward, requiring the use of two hands, i.e. a first hand to hold the hook and a second hand to thread the hook through the loops on the rods. Since there are two sets of rods, this process must be done twice.

In addition, since there are two sets of rods, there are two independent sources of resistance. The two independent sources of resistance add a level of complexity to the use of the exercise apparatus. For example, the user must carefully monitor the amount of resistance used on each set of rods in order to maintain equilateral workout resistances for each side of the body. Moreover, the length of the user's stroke is limited to how far the ends of the flexible rods can be displaced, whereas certain exercises require a long stroke.

There is, therefore, a need for an improved exercise device that utilizes flexible members to provide resistance. There is a need for an exercise device having readily adjustable resistance that is simple and efficient. There is also a need for a device that has an efficient stroke length. There is additionally a need for a device that has a mechanism for providing preprogrammed exercise routines.

BRIEF SUMMARY OF THE INVENTION

The present invention relates to an exercise apparatus with a single resistance rod configured to provide resistance for use in exercise. Additionally the present invention relates to an electronic weight selector mechanism for use with a resistance rod. The electronic resistance selector system utilizes resistance from the elongate rod to allow the user to select an amount of resistance to be utilized during exercise.

The electronic weight selector mechanism can include a variable resistance system and an electronic weight selector control. The variable resistance system includes a cable and pulley system that compounds the force exerted by the user on the cable and pulley system allowing the user a greater extension length compared to the amount the resistance rod is displaced. Additionally, the variable resistance system includes a lever arm having an adjustable effective length. The adjustable effective length of the lever arm allows the user to change the amount of resistance by altering the amount of mechanical advantage provided by the lever arm.

The electronic weight selector control allows the user to select an amount of resistance to be utilized during exercise without having to manually adjust components of the system. Additionally, the weight selector control can include preprogrammed exercise routines that assist the user in performing exercise by automatically setting amounts of resistance, numbers of sets, and numbers of repetitions for particular exercises, and combinations of exercises to be performed. According to one aspect of the present invention, the preprogrammed exercise routines can be customized by the user. For example, the user can change the amount of weight, the numbers of sets or repetitions, or elect to skip an exercise in the preprogrammed routine.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to an exercise apparatus 1 with a single resilient elongate rod 22 configured to provide resistance for use in exercise. Additionally, the present invention relates to an electronic resistance selector system for use with a resistance or resilient rod. The electronic resistance selector system allows the user to select an amount of resistance to be utilized during exercise and subsequently controls application of the resistance through the full range of motion according to a user selected routine, including automatically setting amounts of resistance, numbers of sets and repetitions of particular exercises, and combinations of exercises to be performed. In this manner, the exercise apparatus 1 of the present invention provides a user with controllable resistances, while providing the user with a range of motion that is greater than the amount that the resilient elongate rod 22 is displaced during the exercise.

Figure 1:
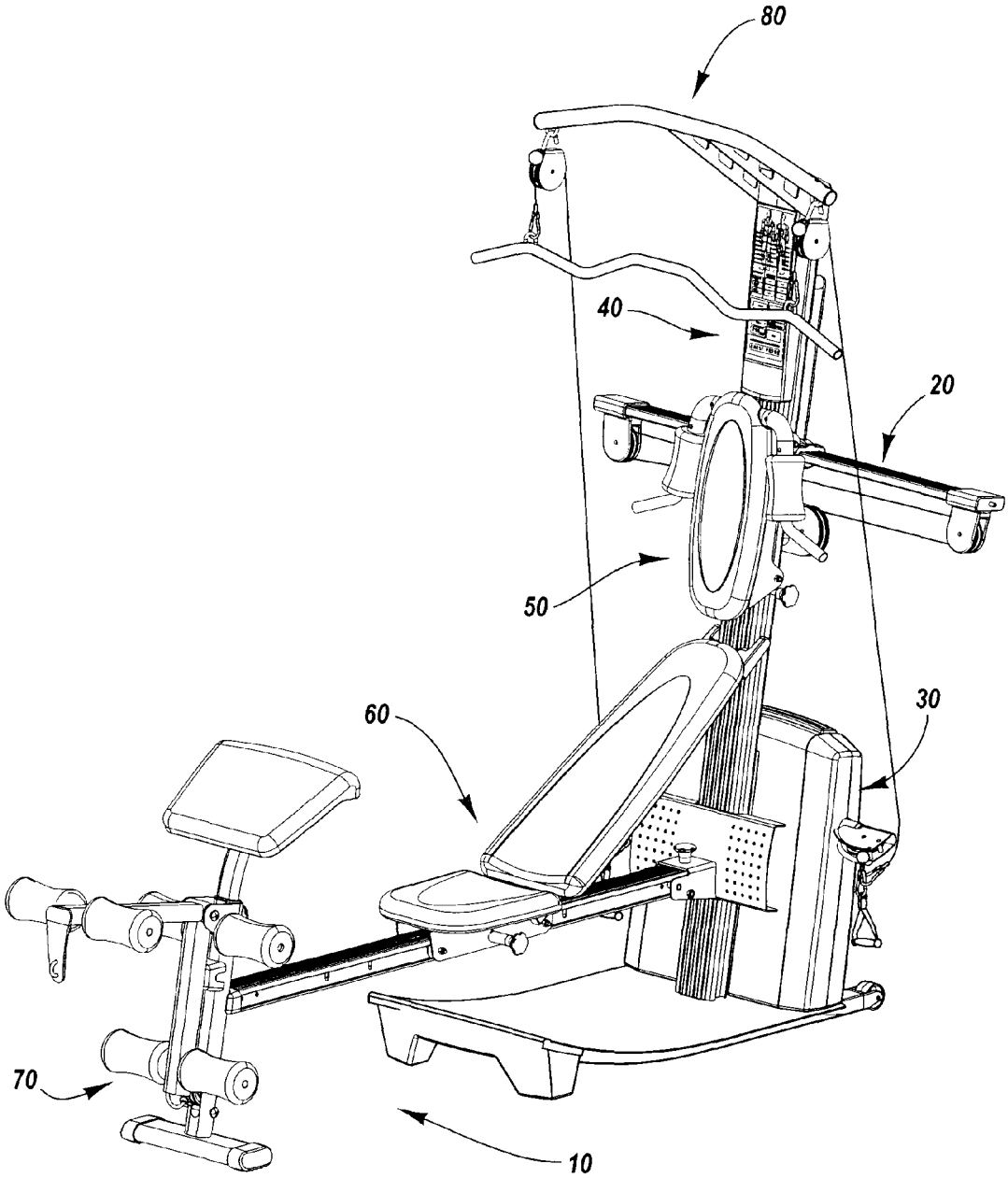
FIG. 1 is a perspective view that illustrates the exercise machine having a single resilient member according to one aspect of the present invention.

FIG. 1 illustrates an exercise apparatus 1 according to one aspect of the present invention. Exercise apparatus 1 provides a mechanism for allowing a user to undertake aerobic and anaerobic exercises in a home or institutional gym setting. Exercise apparatus 1 provides a mechanism for allowing a user to undertake a variety of types and configurations of exercises without needing an exercising partner to assist in the management of the resistance apparatuses during exercise. In the illustrated embodiment, exercise apparatus 1 includes a support frame 10, a resistance assembly 20, a variable resistance system 30, and an electronic weight selector control 40. The exercise apparatus 1 also includes a squat apparatus 50, a bench 60, a bicep/quadricep exerciser 70, and a lat tower 80, that will be discussed in more detail hereinafter. As will be appreciated by those skilled in the art, a variety of types and combinations of components can be utilized with exercise apparatus without departing from the scope and spirit of the present invention.

Support frame 10 provides a structure upon which other components of exercise apparatus 1 are positioned. Additionally, support frame 10 provides stability to exercise apparatus 1 to provide a safe exercise environment. Resistance assembly 20 is positioned adjacent to support frame 10. In the illustrated embodiment, adjacent means on or next to the support frame 10. Resistance assembly 20 includes a resilient elongate rod 22 and a cable a pulley system 340 (see FIG. 5). The single resilient elongate rod 22 provides resistance by flexing while the cable and pulley system 340 allows the user to utilize resistance from the resilient elongate rod 22 to perform exercise. The resilient elongate rod 22 flexes to provide resistance for use in exercise.

Variable resistance system 30 is coupled to resistance assembly 20. Variable resistance system 30 is configured to utilize resistance from resilient elongate rod 22 to provide a variable amount of resistance for use in exercise. Electronic weight selector control 40 is coupled to support frame 10 and electronically linked to variable resistance system 30. Electronic weight selector control 40 allows a user to select an amount of resistance to be used in exercise without having to manually adjust components of the system. Variable resistance system 30 and electronic weight selector control 40 comprises an electronic resistance selector system according to one aspect of the present invention.

Exercise apparatus 1 also includes squat apparatus 50, bench 60, bicep/quadricep exerciser 70, and lat tower 80. Squat apparatus 50 is coupled to an upright component support member of support frame 10. Squat apparatus 50 allows a user to utilize resistance from resilient elongate rod 22 to perform squat exercise routines. Bench 60 is also coupled to support frame 10. Bench 60 provides a surface on which a user can sit or lay to perform certain exercise routines including the bench press, seated flies, bench curls, and the like. In the illustrated embodiment, bench 60 is slideable along a portion of support frame 10. Bicep/quadricep exerciser 70 is coupled to support frame 10 at a distal portion of support frame 10. Bicep/quadricep exerciser 70 allows the user to utilize resistance from the single resilient elongate member to perform a variety of exercises including the bicep curl, quadricep lift, hamstring curl, and a variety of other types and configurations of exercises.

Lat tower 80 is also coupled to support frame 10. Lat tower 80 allows a user to perform lat pull down and other exercises. As will be appreciated by those skilled in the art, a variety of types and configurations of exercise machines can be utilized without departing from the scope and spirit of the present invention. For example, in one embodiment an exercise machine does not include all of the illustrated components, such as lat tower or bicep/quadriceps exerciser. In an alternative embodiment, an exercise machine having a single resistance rod is utilized with exercise components not illustrated in FIG. 1. In yet another embodiment, an electronic resistance selector system is used with a plurality of resistant rods.

Figure 2:
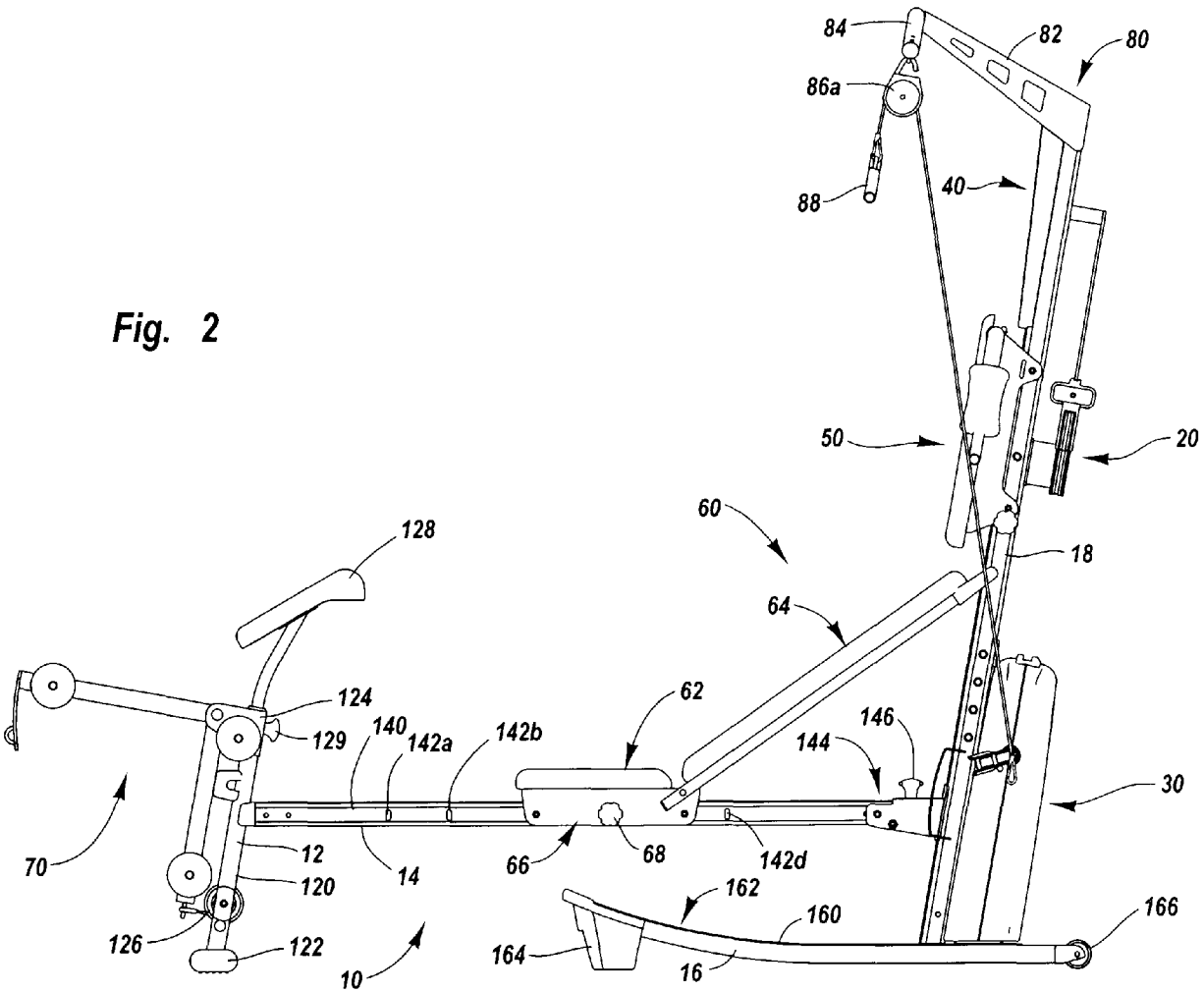
FIG. 2 is a side view of the exercise machine of FIG. 1 according to one aspect of the present invention.

FIG. 2 shows a side view of exercise apparatus 1 according to one aspect of the present invention. As previously discussed, exercise apparatus 1 includes a support frame 10, a bench 60, and a lat tower 80. Support frame 10 is adapted to provide stability to exercise machine 1 while also providing a structure to which additional components of exercise machine 1 can be coupled. Support frame 10 includes a leg support 12, a horizontal member 14, a support base 16, and an upright component support member 18.

Leg support 12 is positioned at the distal end of exercise apparatus 1. Leg support 12 provides an upright structural support to horizontal support member 14. Additionally, leg support 12 provides a structure for connecting bicep/quadricep exerciser 70 to exercise apparatus 1. In the illustrated embodiment, leg support 12 includes an upright member 120 that connects to and supports horizontal member 14. Base support 122 is disposed upon an end of upright member 120.

Base support 122 provides lateral support to upright member 120 to minimize lateral sliding or tipping of upright member 120.

Pulley 126 is positioned proximally to base support 122. Pulley 126 receives a cable (not shown) that extends from bicep/quadriceps exerciser 70 to variable resistance system 30 when a user is utilizing bicep/quadriceps exerciser 70. Connected to the opposite end of upright member 120, by way of a connector assembly 124 and upright member 120, is bicep/quadriceps exerciser 70. A locking pin 129 can be disposed through upright member 120 and engage pedestal 128, to maintain the position of pedestal 128 relative to upright member 120.

Horizontal support member 14 provides a structural support for bench 60 while also providing support for a user exercising thereon. Horizontal support member 14 is configured to guide bench 60 as a user changes the position of bench 60. Bench 60 can be locked in a plurality of positions along the length of horizontal support member 14 utilizing one or more of bores 142*a*-142*n* and a locking pin 68 associated with bench 60.

Horizontal support member 14 is coupled to leg support 12 and pivotally connected to upright component support member 18 utilizing pivot member 144. Horizontal support member 14 can be locked in a position relative to pivot member 144 by way of locking pin 146. Folding pivot 144 couples horizontal support member 14 to upright component support member 18. Folding pivot 144 allows a user to bias horizontal support member 14 and other distal portions of exercise machine 1 into a folded position. By allowing the distal portions of the exercise machine to be positioned in a folded position, folding pivot 144 allows the size and space required to store the exercise apparatus to be substantially reduced providing added convenience and storage capability. Folding locking pin 146 allows a user to lock the position of the horizontal support member relative to the upright component support member 18. Thus when the user desires to maintain a given position such as a folded storage position or unfolded exercise position, the user can utilize the folding locking pin to secure exercise apparatus 1 in the desired position.

Support base 16 is coupled to the lower portion of upright component support member 18. Support base 16 provides lateral stability to exercise apparatus 1 to provide a stable exercising environment. Additionally, support base 16 provides a deck on which various exercises can be performed by a user such as squat routines, standing lat pull downs, and the like. A portion 162 of support base 16 can be inclined relative to the surface of support base 16 upon which a user stands through the use of riser 164. Riser 164 provide lateral and structural support to base 16. Another portion 160 of support base 16 can be generally parallel to the surface.

Generally, support deck 160 provides a surface allowing a user to rest his/her feet thereon thereby allowing a user to perform certain exercise routines such as squats, and other standing or sitting exercise routines. Inclusion of an inclined portion 162 allows a user to position his/her feet at a desired angle during certain exercise routines such as the squat press. Further, this inclined portion 162 minimizes slippage of a user's feet on support base 16 during exercise routines. A variety of types and configurations of inclined portion 162 can be utilized without departing from the scope and spirit of the present invention. For example, in the illustrated embodiment, the inclined surface is gradually inclined from more planar portions of support deck 160. In an alternative embodiment, inclined portion 162 rises sharply and at a distinct angle with respect to other portions of support deck 160. In still another configuration, inclined portion 162 is not included in support base 16 so that support base 16 has the same planar orientation along its length.

Support base 16 further includes one or more rollers 166. Rollers 166 are positioned on the portion of support base 16 opposite riser 164. Rollers 166 provide a structural support member as well as a mechanism for moving exercise apparatus 1. The ability to move exercise apparatus 1 utilizing rollers 166 can be particularly beneficial when exerciser apparatus 1 is in a folded storage position. This allows a user to move exercise apparatus 1 to a closet, room corner, or other desired storage location when exercise apparatus 1 is not in use. In one embodiment, rollers 166 include a first and second roller positioned on opposite lateral sides of support base 16.

Upright component support member 18 is coupled to support base 16 and horizontal support member 14. Upright component support member 18 provides a structure on which other components of the exercise machine can be affixed. For example, in the illustrated embodiment, resistance assembly 20, variable resistance system 30, electronic weight selector control 40, a squat apparatus 50, and a lat tower 80 are positioned on or next to upright component support member 18. As will be appreciated by those skilled in the art, a variety of types and configurations of support frame 10 can be utilized without departing from the scope and spirit of the present invention. For example, in one embodiment, a plurality of leg supports are utilized. In an alternative embodiment, the other components of exercise apparatus 1 are connected to a secondary component instead of to upright component support member 18. In an alternative embodiment, distal components of support frame 10 include a support structure for a bench that is a separate stand alone component from upright component support member 18 and support base 16.

Bench 60 is coupled to horizontal support member 14. Bench 60 provides a surface on which a user can rest to perform exercise routines. Bench 60 includes a seat member 62, a back support 64, a base 66, and a locking pin 68. In the illustrated embodiment, seat member 62 includes a padded surface. Seat member 62 is slidably coupled to horizontal support member 14 utilizing base 66. Back support 64 is pivotally coupled to seat member 62. Back support 64 provides a mechanism for supporting a user's back in either a sitting or inclined position during exercise routines such as bench press, pectoral fly, and the like. Pivotal coupling between seat member 62 and back support 64 allows back support to be placed in a variety of positions and at a variety of angles relative to seat member 62. In one embodiment, back support 64 is removable from seat member 62 permitting a user to conduct certain exercises and/or place exercise apparatus in a folded position.

Base 66 provides a mechanism for coupling bench 60 to horizontal support member 14. Base 66, in this exemplary configuration, includes a plurality of roller wheels (not shown) positioned relative to horizontal support member 14 to allow bench 60 to slide relative to horizontal support member 14. Locking pin 68 is positioned on one side of base 66. Locking pin 68 provides a mechanism for securing a desired bench position. Locking pin 68 is configured to be positioned in bores 142*a*-142*n* to secure bench 60 during exercise or folding of exercise apparatus 1.

Lat tower 80 is positioned on the upper end of upright component support member 18. Lat tower 80 includes a support arm 82, a horizontal member 84, a pulley 86, and a lat bar 88. In the illustrated embodiment, support arm 82 is coupled at an angle to the upper portion of horizontal support member 14. Support arm 82 provides displacement from upright component support member 18 to allow a user to conduct a lat pull down exercises with lat bar 88 being positioned at a desired angle relative to the user. Horizontal member 84 is coupled to support arm 82. Horizontal member 84 provides a mechanism for connecting pulleys 86*a* and 86*b* (not shown) at the desired lateral location to enable exercise with lat bar 88.

Pulleys 86*a* and 86*b* are adapted to route cables to lat bar 88. Pulleys 86*a, b* facilitate smooth and efficient movement of cables and thus lat bar 88. As will be appreciated by those skilled in the art, a variety of types and configurations of lat towers can be utilized without departing from the scope and spirit of the present invention. For example, in one embodiment, bearing members are used in place of pulleys 86*a, b*. In an alternative embodiment, support arm 82 and horizontal member 84 includes an integral unit. In another embodiment, horizontal member 84 is coupled to an upright component support member having a curved upper portion providing the displacement desired.

Figure 3:
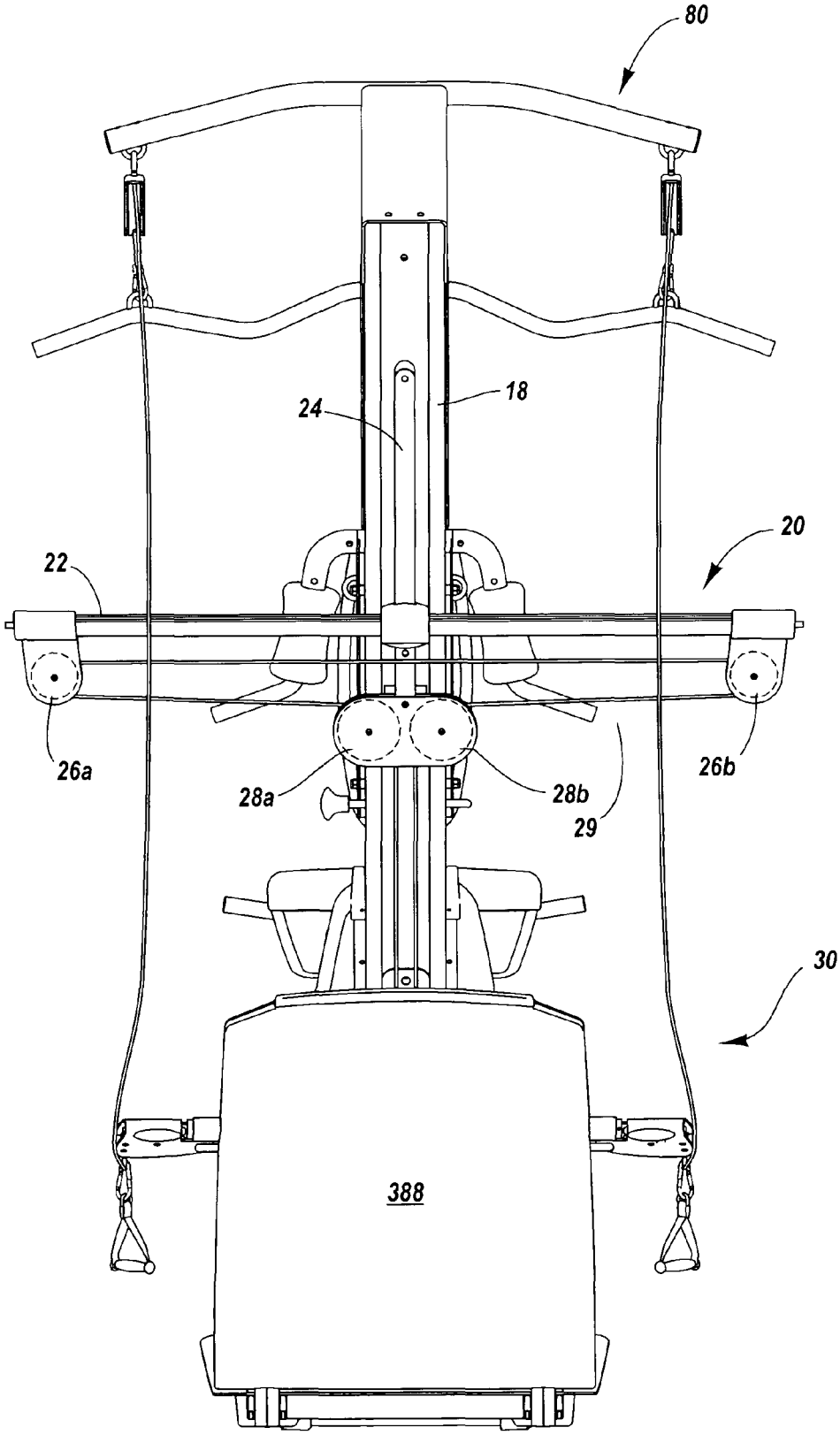
FIG. 3 is a rear view illustrating the resistance assembly of the exercise machine of FIG. 1 according to one aspect of the present invention.

FIG. 3 shows a rear view of exercise apparatus 1 illustrating resistance assembly 20 in greater detail according to one aspect of the present invention. In the illustrated embodiment, resistance assembly 20 includes a resilient elongate rod 22, a guide 24, pulleys 26*a, b* and pulleys 28*a, b*. Resilient elongate rod 22 is configured to provide resistance for use in exercise. Resilient elongate rod 22 is positioned proximal to upright component support member 18 such that no portion of resilient elongate rod 22 is fixed in relation to support frame 10 or upright support member 18. This allows resilient elongate rod 22 to move relative to other portions of exercise apparatus 1 in a flexible and desired manner.

Guide 24 is positioned relative to resilient elongate rod so as to ensure that movement of resilient elongate rod occurs in a predictable and orderly fashion. Guide 24 includes a riser coupler 240 that spaces guide 24 apart from upright support member 18. The desired displacement can substantially correspond with the width of resilient elongate rod 22 between guide member 24 and upright component support member 18.

Disposed at the ends of resilient elongate rod 22 are pulleys 26*a, b*. Pulleys 26*a, b* are positioned below and toward the middle portion of resilient elongate rod 22, although pulley 26*a, b* can be disposed in alignment with or above the end of resilient elongate rod 22. Pulleys 26*a, b* cooperate with pulleys 28*a, b*, which are affixed to upright component support member 18, or more generally, are fixed relative to rod 22, by way of a cable 29. The cable 29 provides a mechanism for conveying resistance from resilient elongate rod 22 to variable resistance system 30. More specifically, movement of variable resistance system 30 is transferred to movement of rods 22 by way of cable 29, pulleys 26*a, b* and 28*a, b*. As will be appreciated by those skilled in the art, resistance assembly 20 can be coupled to other components of exercise machine 1 utilizing a variety of mechanisms and in a variety of manners without departing from the scope and spirit of the present invention.

Figure 4A:
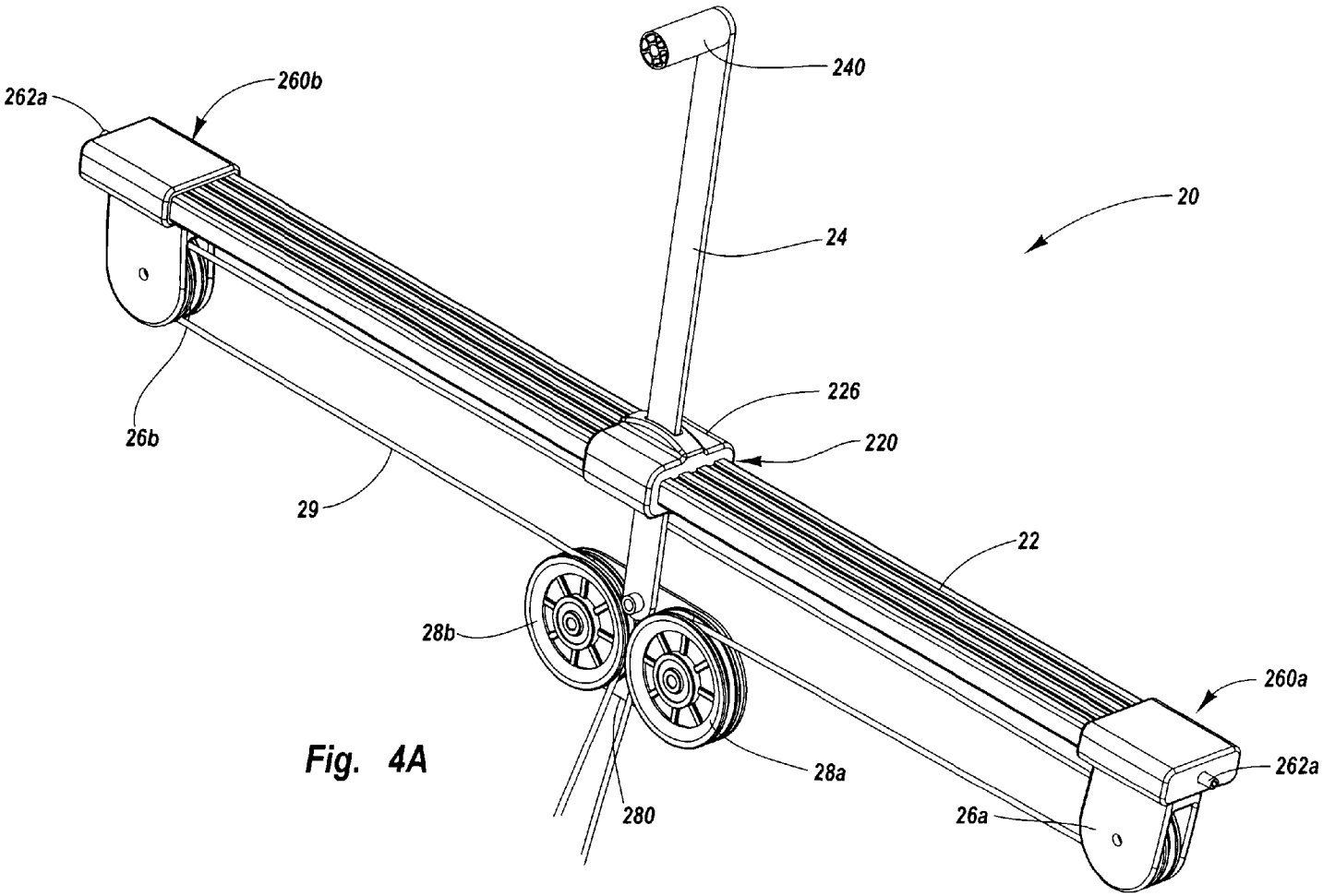
FIG. 4A is a perspective view of the resistance assembly of the exercise machine of FIG. 1 in a relaxed position according to one aspect of the present invention.

FIG. 4A is a perspective view of resistance assembly 20 illustrating resilient elongate rod 22 in a relaxed position. In the illustrated embodiment, a bracket member 226 is disposed at a center portion 220 of rod 22. When resilient elongate rod 22 is in a relaxed position, center portion 220 is positioned at substantially the same elevation as first end 222 and second end 224. Bracket member 226 is positioned at or near center portion 220 of resilient elongate rod 22. Bracket member 226 is configured to slidably engage guide 24. As will be appreciated by those skilled in the art, a variety of types and configurations of bracket members, guides, and other mechanisms for ensuring consistent and predictable movement of resilient elongate rod 22 can be utilized without departing from the scope and spirit of the present invention. In the illustrated embodiment, guide 24 and bracket member 226 allow for free movement of resilient elongate rod 22.

Figure 4B:
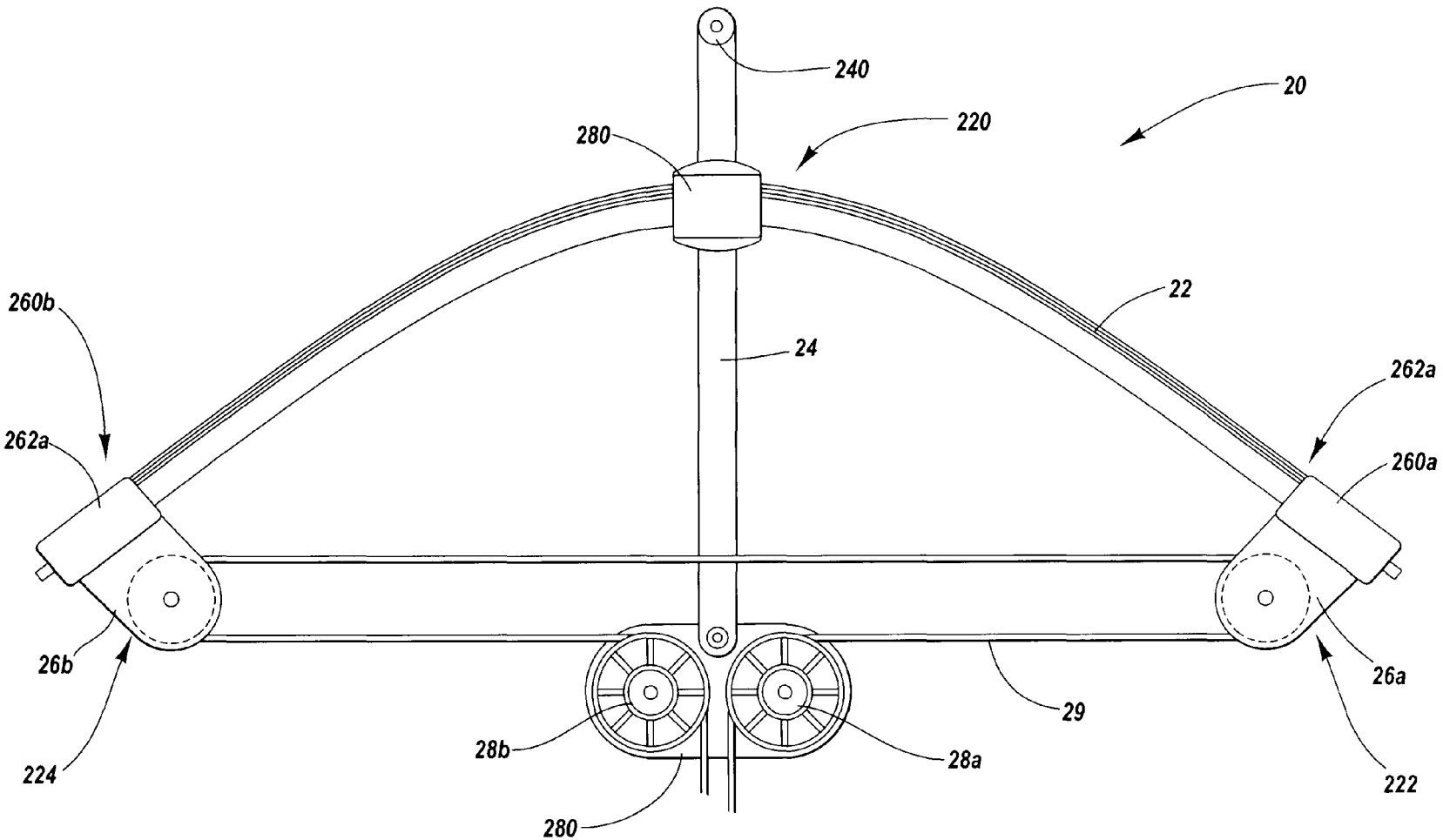
FIG. 4B is a perspective view of the resistance assembly of the exercise machine of FIG. 1 in a flexed position according to one aspect of the present invention.

FIG. 4B illustrates resilient elongate rod 22 in a flexed configuration. During exercise a force is exerted on cable 29 at a point below pulleys 28*a, b* utilizing variable resistance system 30. When a force is exerted on cable 29, that force is conveyed on the upper portion of pulleys 28*a, b*. This causes shortening of the portion of cable 29 above pulleys 28*a, b*. Shortening of the cable 29 causes pulleys 26*a, b* to be pulled toward each other. As pulleys 26*a, b* are pulled toward each other, center portion 220 of resilient elongate rod 22 moves toward riser coupler 240 and rod 22 begins to flex. Guide 24 prevents excessive lateral displacement of resilient elongate rod 22 when resilient elongate rod 22 flexes. Therefore, no portion of resilient elongate rod 22 is fixed in relation to support frame 10. As a result, first end 222, second end 224, and center portion 220 all move relative to one another and to other components of exercise machine 1 during exercise.

As will be appreciated by those skilled in the art, a variety of types and configurations of a resistance assembly can be utilized without departing from the scope and spirit of the present invention. For example, in one embodiment, the single resilient elongate rod is comprised of a plurality of resilient elongate rods that work together cooperatively. In another embodiment, a plurality of resilient elongate rods are utilized. In another embodiment, two separate cables are coupled to each end of the single resilient elongate rod.

In the illustrated embodiment, pulley length adjustment mechanisms 260*a* and 260*b* are provided. Due to the configuration of variable resistant system 30, the amount of force required to flex resilient elongate rod 22 without utilizing the variable resistant system 30 can far exceed the capabilities of a normal user. As a result, a user may not be able to properly thread cable 29 around pulleys 26*a, b* and pulleys 28*a, b* during assembly or adjustment of exercise apparatus 1 under normal circumstances. Pulley length adjustment mechanisms 260*a, b* disposed at ends 222 and 224 of rod 22 permit lateral displacement of pulleys 26*a, b* allowing a user to loosen and/or tighten cable 29. Pulley length adjustment mechanisms 260*a, b* include adjustment member 262*a, b*.

According to one embodiment of the present invention, adjustment mechanisms 260*a, b* are slidably disposed at the ends 222 and 224 of rod 22. Adjustment members 262*a, b* comprise threaded members that engage the ends 222 and 224 of rod 22. When a user rotates adjustment members 262*a, b* in a first direction, pulley length adjustment mechanisms 260*a, b* cooperatively interact with adjustment members 262*a, b* to move closer to center portion 220. As pulley length adjustment mechanisms 260*a, b* move closer to center portion 220, tension on cable 29 is lessened allowing a user to adjust and/or remove cable 29 from pulleys 26*a, b* and pulleys 28*a, b*.

Once a cable is properly positioned on pulleys 26*a, b* and 28*a, b* and pulley length adjustment mechanisms 260*a, b* have been moved in the direction of center portion 220, a user rotates adjustment members 262*a, b* in the opposite direction. By rotating the adjustment members 262*a, b* in the opposite direction, pulley length adjustment mechanisms 260*a, b* move toward first end 222 and second end 224. As pulley length adjustment mechanism 260*a* moves towards first end 222 and as pulley length adjustment mechanism 260*b* moves toward second end 224, tension on cable 29 increases. As the tension on cable 29 increases, resilient elongate rod 22 is properly positioned for use during exercise. In the illustrated embodiment, there is also shown a pulley housing 280. Pulley housing 280 maintains the position of pulleys 28*a, b* relative to one another. By maintaining the position of pulleys 28*a, b* relative to one another, uniform and predictable movement of resilient or elongate rod 22 is maintained.

Figure 5:
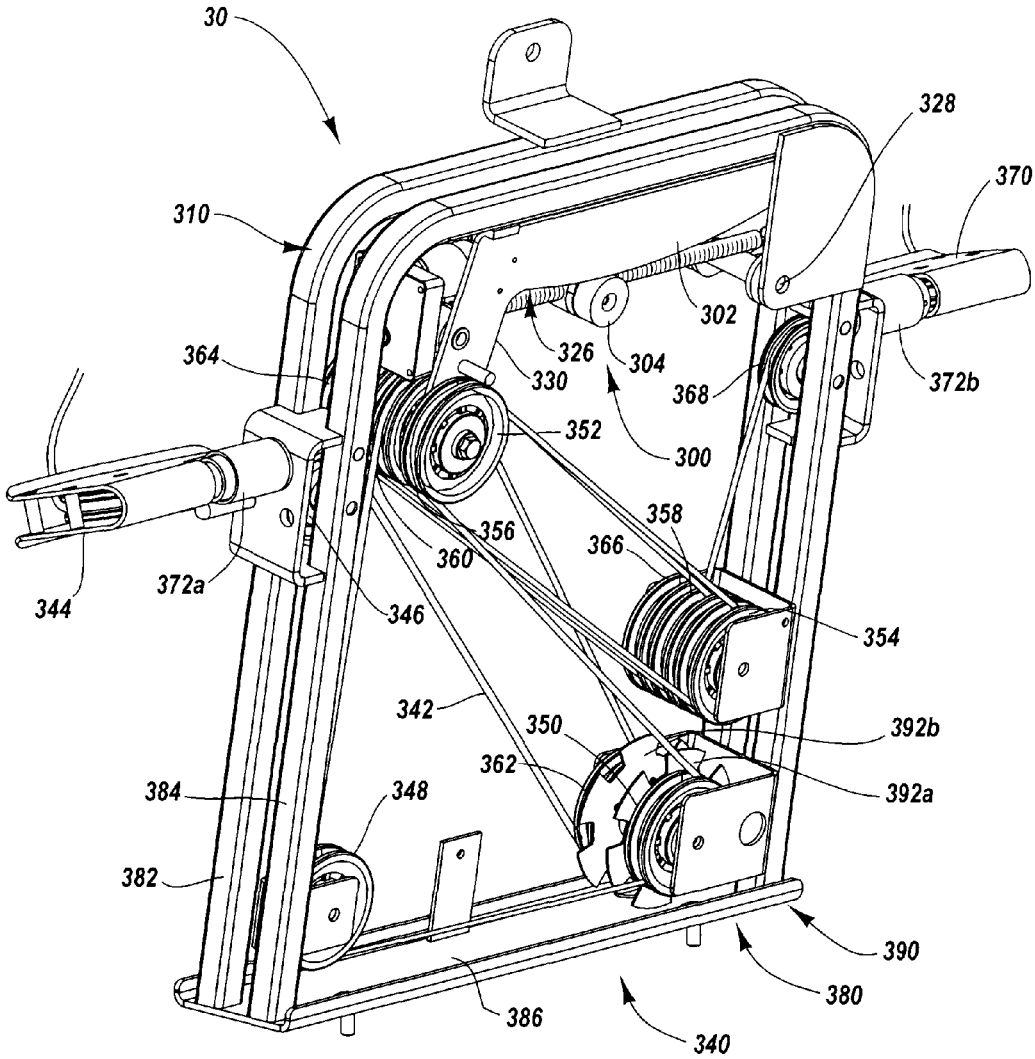
FIG. 5 shows the variable resistance system of the exercise machine of FIG. 1 according to one aspect of the present invention.

FIG. 5 illustrates a variable resistance system 30 according to one aspect of the present invention. Variable resistance system 30 is configured to utilize resistance from one or more resilient elongate rods to provide a variable amount of resistance for use in exercise. Variable resistance system 30 is coupled to upright component support member 18 at a transverse orientation. In the illustrated embodiment, variable resistance system 30 includes an automatic resistance adjustment mechanism 300, a cable and pulley system 340, a housing 380, and a repetition sensor 390.

Housing 380 is coupled to upright component support member 18 (FIG. 2). Housing 380 provides a support structure on which other components of variable resistance system 30 can be mounted. Housing 380 includes a first frame member 382, a second frame member 384, a frame base 386, and a casing 388 (see FIG. 3). First frame member 382 and second frame member 384 provide structural support and protection to other components of variable resistance system 30. First and second frame members 382 and 384 provide sufficient strength to withstand resistance exerted on automatic resistance adjustment mechanism 300 and pulley system 340.

Frame base 386 is coupled to the bottom of first and second frame members 382 and 384. Frame base 386 is also adapted to be coupled to upright component support member 18 and support base 16. A casing 388, as shown in FIG. 3, is adapted to be positioned over first frame member 382, second frame member 384, frame base member 386, and other components of variable resistance system 30. Casing 388 provides a decorative covering while also protecting the internal components of variable resistance system 30 from damage. Additionally, casing 388 prevents a user from interfering with operation of cable and pulley system 340.

Automatic resistance adjustment mechanism 300 is pivotally mounted to housing 380. In the illustrated embodiment, automatic resistance adjustment mechanism 300 is disposed between first frame member 382 and second frame member 384. Automatic resistance adjustment mechanism 300 cooperatively interacts with electronic weight selector control 40 to allow a user to select an amount of resistance to be utilized during exercise. Automatic resistance adjustment mechanism 300 automatically changes the amount of resistance provided by variable resistance system 30 without requiring the user to manually adjust components of exercise apparatus 1.

In the illustrated embodiment, automatic resistance adjustment mechanism 300 includes a lever arm 302, a lever arm length regulator 304, and a lead screw motor assembly 310. Lever arm 302 cooperatively interacts with cable and pulley system 340 to regulate the amount of resistance required to displace resistance assembly cable 29 and by extension resilient elongate rod 22. Lever arm length regulator 304 is linked to resistance assembly cable 29 to cause displacement of resilient elongate rod 22. In the present invention, linked means directly coupled or indirectly coupled. Lever arm length regulator 304 changes the effective length of lever arm 302 to provide a greater or lesser amount of mechanical advantage. By changing the amount of mechanical advantage provided by lever arm 302, a greater or lesser amount of resistance is required to flex resilient elongate rod 22. Lever arm length regulator 304 is moved laterally by means of lead screw motor 314. Lead screw motor assembly 310 is coupled to lever arm 302 and lever arm length regular 304. When a user selects a change in the amount of resistance with which to exercise utilizing electronic weight selector control 40, lead screw motor assembly automatically changes the position of lever arm length regulator to provide the desired amount of leverage benefit and thereby the desired amount of resistance for use during exercise.

Lever arm length regulator 304 engages a curved surface 326 of lever arm 302. Curved surface 326 is configured to maintain a constant tension on resistance assembly cable 29 notwithstanding the lateral position of lever arm length regulator 304 along lever arm 302. A pivot 328 provides a pivot point for lever arm 302. Additionally, pivot 328 provides a point of coupling between lever arm 302 and housing 380.

An angle portion 330 of lever arm 302 positions the pulleys coupled to lever arm 302 at a desired displacement relative to other pulleys of the cable and pulley system 340. This allows lever arm 302 to provide a desired effective lever arm length and predetermined mechanical advantage. The operation of lever arm 302 and other components of lead screw motor assembly 310 will be described in greater detail with reference to FIGS. 7A, 7B, 7C, and 7D.

Cable and pulley system 340 is coupled to several components of variable resistance system 30 including lever arm 302 and housing 380. Cable and pulley system 340 provides a compound pulley system to minimize the amount of force required to flex resilient elongate rod 22. In the illustrated embodiment, cable and pulley system 340 includes a cable 342, pulleys 344, 346, 348, 350, 352, 354, 356, 358, 360, 362, 364, 366, 368, 370 and rotatable couplers 372*a,b*.

The first and second ends of cable 342 are utilized by a user during exercise routines. The ends of cable 342 can be coupled to exercise apparatus hand grips, or other mechanisms allowing a user to exert a force on the cable 342. The following is a discussion of an illustrative routing of cable 342 through pulleys 344, 346, 348, 350, 352, 354, 356, 358, 360, 362, 364, 366, 368, 370 and is not intended to restrict the scope and spirit of the present invention. Cable 342 is routed through pulleys 344, 346, 348, 350, 352, 354, 356, 358, 360, 362, 364, 366, 368, 370 to ensure smooth and efficient movement of cable 324, as well as to provide a compounding effect on the amount of resistance exerted by the user. A first end of cable 342 extends from pulley 344. Cable 342 is then routed from pulley 344 through pulley 346 and around pulley 348. From pulley 348, cable is routed through pulley 350, around pulley 352, to pulley 354. From cable 354 cable is routed back to pulley 356, around pulley 358 to pulley 360. From pulley 360 cable is routed around pulley 362, up and around pulley 364, and down around pulley 366. From pulley 366 cable is routed around pulley 368 and finally around pulley 370 from which the second end of cable 342 extends.

The configuration of cable 342 and its juxtaposition with pulleys 344, 346, 348, 350, 352, 354, 356, 358, 360, 362, 364, 366, 368, 370 compounds the force exherted by the user on the cable and pulley system while also ensuring smooth and efficient operation of the movement of the cable. As will be appreciated by those skilled in the art, a variety of types and configurations of routing cable 342 through pulleys 344, 346, 348, 350, 352, 354, 356, 358, 360, 362, 364, 366, 368, 370 can be utilized without departing from the scope and spirit of the present invention.

During an exercise routine the user exerts a force on one or both ends of cable 342. As one or both ends of cable 342 are displaced, the end of lever arm 302 corresponding with angle portion 330 and cables 352, 356, 360 and 364 move toward pulleys 354, 358, and 366. Resistance from the ends of resilient elongate rod 22 is conveyed to lever arm 302 by cable 29 of resistance assembly 20. Movement of the end of lever arm 302 corresponding with angel portion 330 results in displacement of resistance assembly cable 29. Movement of cable 29 results in flexing of resilient elongate rod providing resistance for use in exercise.

As previously discussed, variable resistance system 30 operates in connection with electronic weight selector control to move lever arm length regulator 304 to change the effective length of lever arm 302 thus changing the amount of resistance experienced by the user when moving the ends of cable 342. By providing a quick and efficient mechanism for changing the amount of resistance utilized during exercise, exercise apparatus 1 provides an efficient and user friendly mechanism for exercising.

In the illustrated embodiment, a set/rep sensor 390 is shown. Set/rep sensor 390 automatically detects the number of sets and repetitions that are performed by a user during an exercise being performed. In the illustrated embodiment, set/rep sensor comprises a magnetic sensor. Set/rep sensor includes a first wheel 392*a* and a second wheel 392*b*. First and second wheels 392*a, b* include a metal disk with a plurality of voids formed therein. The voids allow a sensor mechanism (not shown) to detect both the movement and the direction of rotation of the metal disk. In the illustrated embodiment, each direction change corresponds with one half of a repetition. Typically a set of an exercise routine includes a plurality of repetitions. As will be appreciated by those skilled in the art, a variety of types and configurations of sensors can be utilized without departing from the scope of the present invention. For example, in one embodiment the sensor includes a light sensor. In an alternative embodiment, the sensor detects movement of the lever arm.

Figure 6:
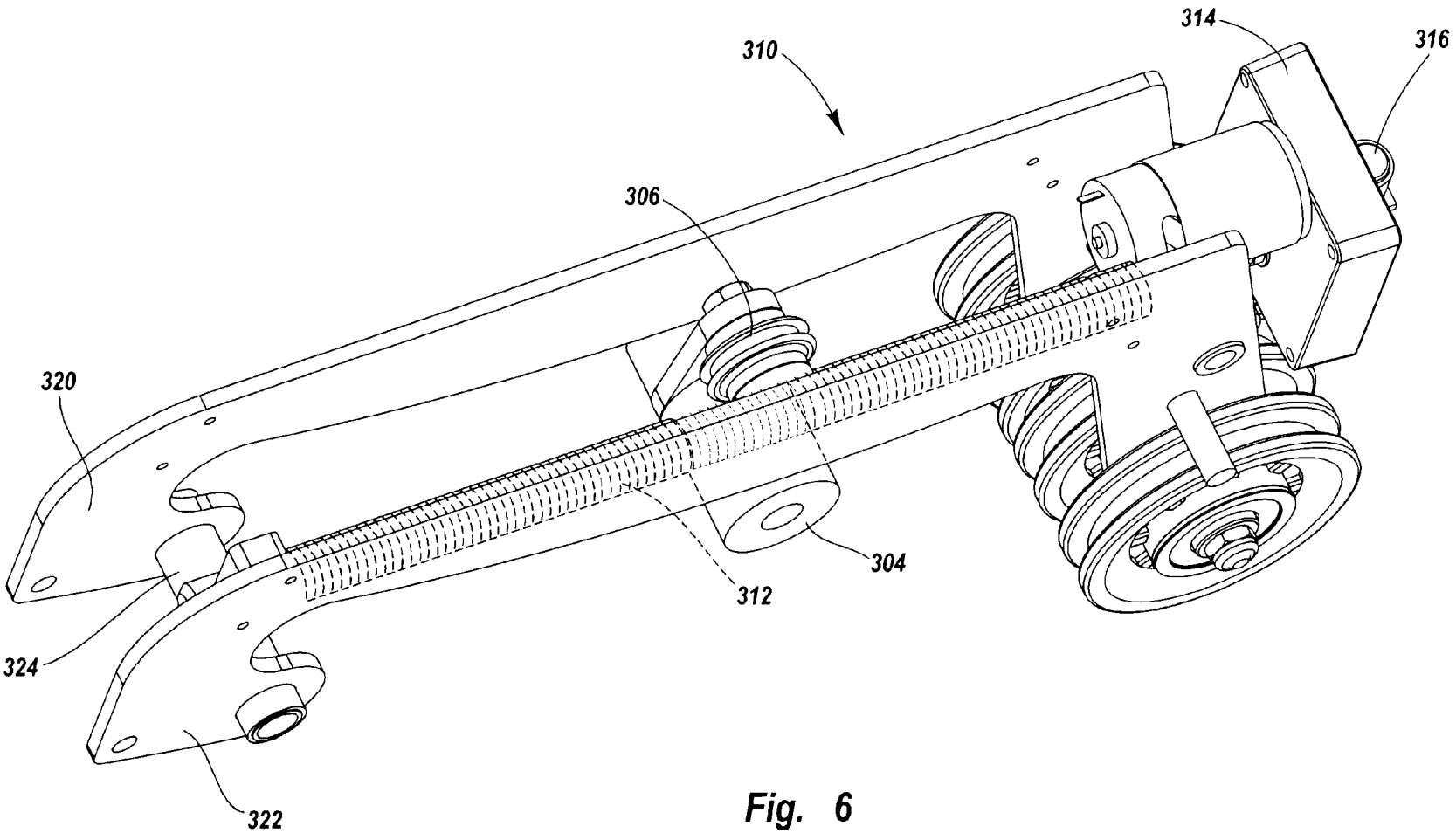
FIG. 6 is a top perspective view of the automatic resistance adjustment mechanism of the exercise machine of FIG. 1 according to one aspect of the present invention.

FIG. 6 is a top perspective view of lever arm 302 illustrating lead screw motor assembly 310 in greater detail. In the illustrated embodiment, lead screw motor assembly 310 includes a lead screw 312, lead screw motor 314, and a lead screw sensor 316. Lead screw 312 is threadably coupled to lever arm length regulator 304. Lead screw 312 is rotated utilizing lead screw motor 314. When lead screw 312 is rotated in one direction, lever arm length regulator is cooperatively engaged by the threads of the lead screw 312 and moves in the direction of pivot 328. When lead screw motor 314 is turned in the opposite direction, lever arm length regulator 304 is cooperatively engaged by the threads of lead screw 312 and moves in the direction of lead screw motor 314.

Lead screw motor 314 is coupled to lever arm 302. Lead screw motor 314 provides the rotational force necessary to cause rotation of lead screw 312 and thereby lateral movement of lever arm length regulator 304. According to one aspect of the present invention, lead screw motor 314 includes a DC motor with an attached gear box. As will be appreciated by those skilled in the art, a variety of types and configurations of motors can be utilized without departing from the scope and spirit of the present invention.

A lead screw sensor 316 is coupled to lead screw motor 314. Lead screw sensor 316 monitors the rotation of lead screw 312 and/or lead screw motor 314 to ascertain the position of lever arm length regulator 304. By ascertaining the position of lever arm length regulator 304, lead screw sensor 316 enables exercise apparatus 1 to automatically regulate the amount of the resistance provided by variable resistance system 30 and resistance assembly 20.

In the illustrated embodiment, lever arm 302 includes a first member 320, a second member 322, and a coupler 324. First and second members 320 and 322 both include a curved surface and an angled portion. First and second member 320 and 322 are connected at one end by coupler 324. The curved surface portions of first member and second member 320 and 322 engage lever arm length regulator 304. Lead screw 312 is positioned between first member 320 and second member 322. As will be appreciated by those skilled in the art, a variety of types and configurations of lever arms can be utilized without departing from the scope and spirit of the present invention. For example, in one embodiment, the lever arm includes a single lever member adapted to accommodate a lead screw and lever arm regulator. In an alternative embodiment, the actual length of the lever arm is adapted to be adjusted instead of utilizing a lever arm length regulator.

In the illustrated embodiment, it can be seen that lever arm length regulator 304 is coupled to a pulley 306. Pulley 306 accommodates resistance assembly cable 29. When the end of lever arm 302 is displaced, the portion of resistance assembly cable 29 positioned in pulley 306 is displaced with lever arm 302.

Figure 7A:
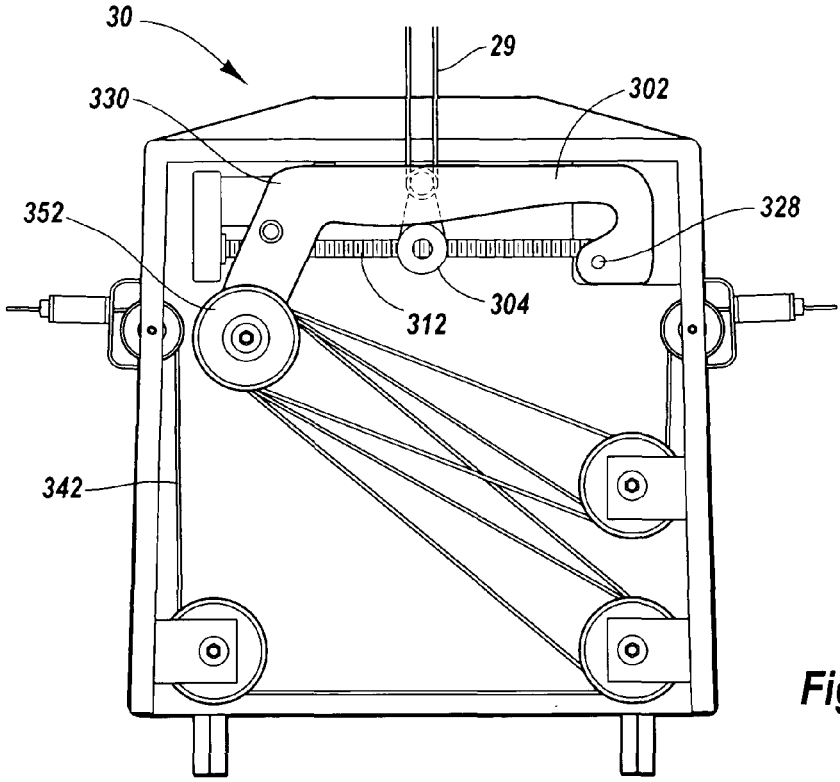
FIG. 7A illustrates the automatic resistance adjustment mechanism of the exercise machine of FIG. 1 in which the lever arm is in a first position.

FIG. 7A illustrates a variable resistance system 30 with lever arm length regulator 304 in an intermediate position. In the illustrated embodiment, lever arm 302 is in a relaxed position causing little or no displacement of cable 29. The current position of lever arm 302 is achieved when insufficient resistance is exerted on a cable and pulley system 340 to cause movement of the end of lever arm 302 corresponding with angle portion 330.

Figure 7B:
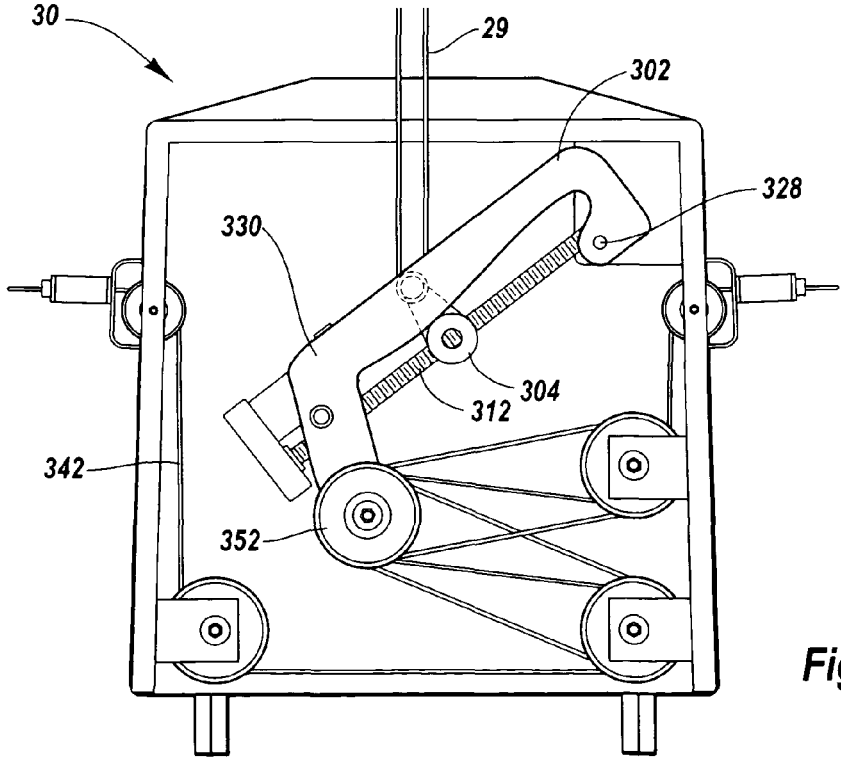
FIG. 7B illustrates the automatic weight resistance adjustment mechanism of the exercise machine of FIG. 1 in which the lever arm is in a second position.

FIG. 7B shows a lever arm 302 in a displaced configuration. The illustrated configuration of lever arm 302 is achieved when sufficient force is exerted on the pulleys coupled to angle portion 330 of lever arm 302. The displacement of the end of lever arm 202 corresponding with angle portion 330 results in movement of lever arm length regulator 304 and resistance assembly cable 29. Movement of resistance assembly cable 29 results in flexing of resilient elongate rod 22. As previously discussed, the configuration of lever arm 302 results in movement of lever arm about pivot 328.

Figure 7C:
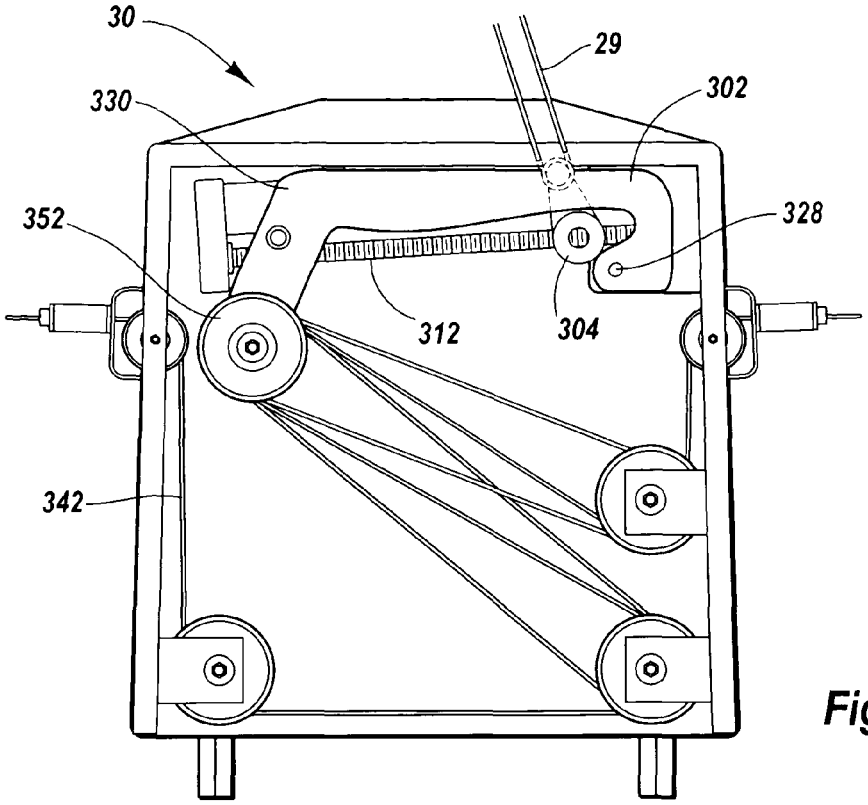
FIG. 7C illustrates the automatic weight resistance adjustment mechanism of the exercise machine of FIG. 1 in which the lever arm length regulator is in a first position.

FIG. 7C illustrates lever arm length regulator 304 at a lateral position adjacent pivot 328. In the illustrated position, lever arm length regulator 304 is at or near its greatest lateral displacement adjacent pivot 328. The illustrated position of lever arm length regulator 304 also corresponds with the smallest amount of resistance being experienced by the user. According to one embodiment of the present invention, a weight of less than 10 pounds is provided when lever arm length regulator 304 is in the illustrated position.

The actual resistance experienced by the user is the result of a variety of factors including the length of the lever arm and the configuration of the cable and pulley system 340. In this position, the mechanical advantage provided by lever arm 302 is at its greatest. As a result, displacement of cable 342 produces a large amount of movement of the end of lever arm 302 corresponding with angle portion 330. While a large amount of movement of lever arm 302 is experienced, displacement of lever arm length regulator 304 and resistance assembly cable 29 is minimal.

The compounding effect provided by the configuration of cable and pulley system 340 results in a large amount of displacement of cable 342 of the cable and pulley system but a smaller amount of displacement of the end of lever arm 302 corresponding with angle portion 330. This compound pulley effect allows the user to obtain a large amount of extension of the ends of cable 342 for a small amount of flexing of resilient elongate rod 22. The combination of the compounding effect of cable and pulley system 340 and mechanical advantage of lever arm 302 results in large amount of overall mechanical advantage. Thus, a small amount of effort is required to flex resilient elongate rod 22.

According to one embodiment of the present invention, a resilient resistance member (e.g. a biasing spring) is coupled to the end of lever arm 302 corresponding with pivot 328. The resilient resistance member provides another source of resistance to variable resistance system 30. The small amount of resistance provided by the resilient resistance member allows a desired amount of minimum resistance to be provided where the effective length of lever arm 302 would provide insufficient resistance. As will be appreciated by those skilled in the art, a variety of types and configurations of resilient resistance members can be utilized without departing from the scope and spirit of the present invention. For example in one embodiment, the resilient resistance member provides a counter acting force to lower to the total resistance provided by the variable resistance system 30 and resistance assembly 20. In another embodiment, resilient resistance member comprises a resilient band.

Figure 7D:
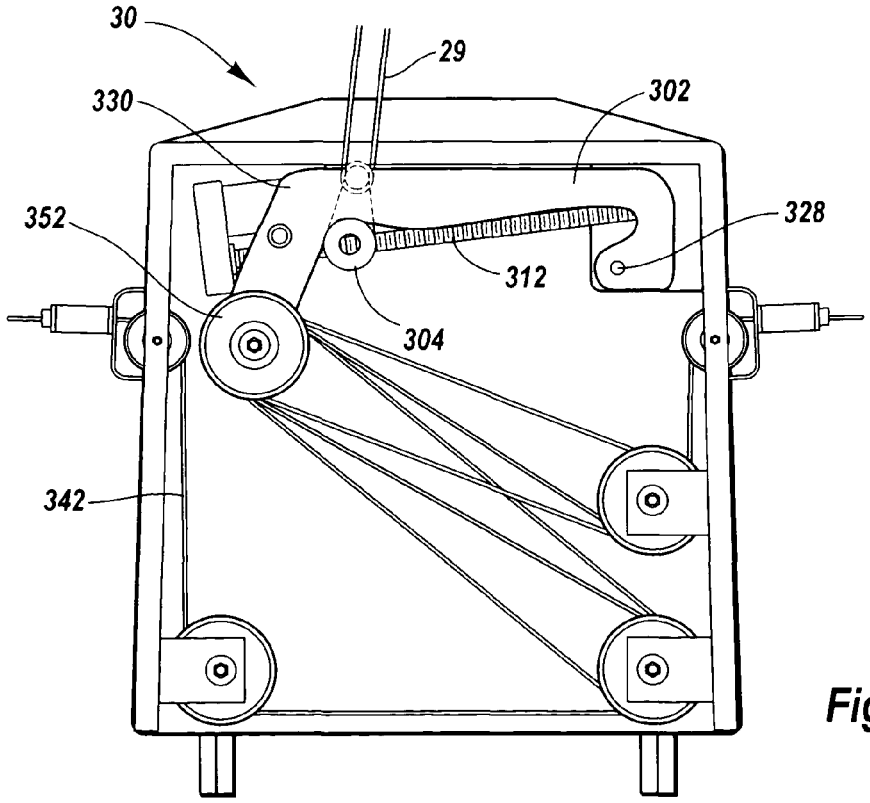
FIG. 7D illustrates the automatic weight resistance adjustment mechanism of the exercise machine of FIG. 1 in which the lever arm length regulator is in a second position.

FIG. 7D illustrates a variable resistance system 30 with a lever arm length regulator 304 positioned adjacent the portion of lever arm 302 corresponding with angle portion 330. The illustrated position of lever arm length regulator 304 results in a minimal mechanical advantage being provided by lever arm 302 based on the small effective length of lever arm 302. When user exerts a force on the ends of cable 342, displacement of the end of lever arm 302 corresponding with angle portion 330 is effectively the same displacement of lever arm length regulator 304. As a result, displacement of the end of lever arm 302 corresponding with angle portion 330 results in a large amount of displacement of resistance assembly cable 29. The large amount of displacement of cable 29 and the small amount of mechanical advantage provided by lever arm 302 results in a large amount of resistance being required to flex the resilient elongate member.

According to one embodiment of the present invention, the amount of resistance experienced when lever arm length regulator 304 is in the illustrated position is approximately 440 pounds of resistance. In an alternative embodiment, the amount of the resistance experienced is approximately 340 pounds. As will be appreciated by those skilled in the art, a variety of types and configurations of variable resistance systems 30 can result in a variety of types and amounts of resistance experienced by the user without departing from the scope and spirit of the present invention.

Figure 8:
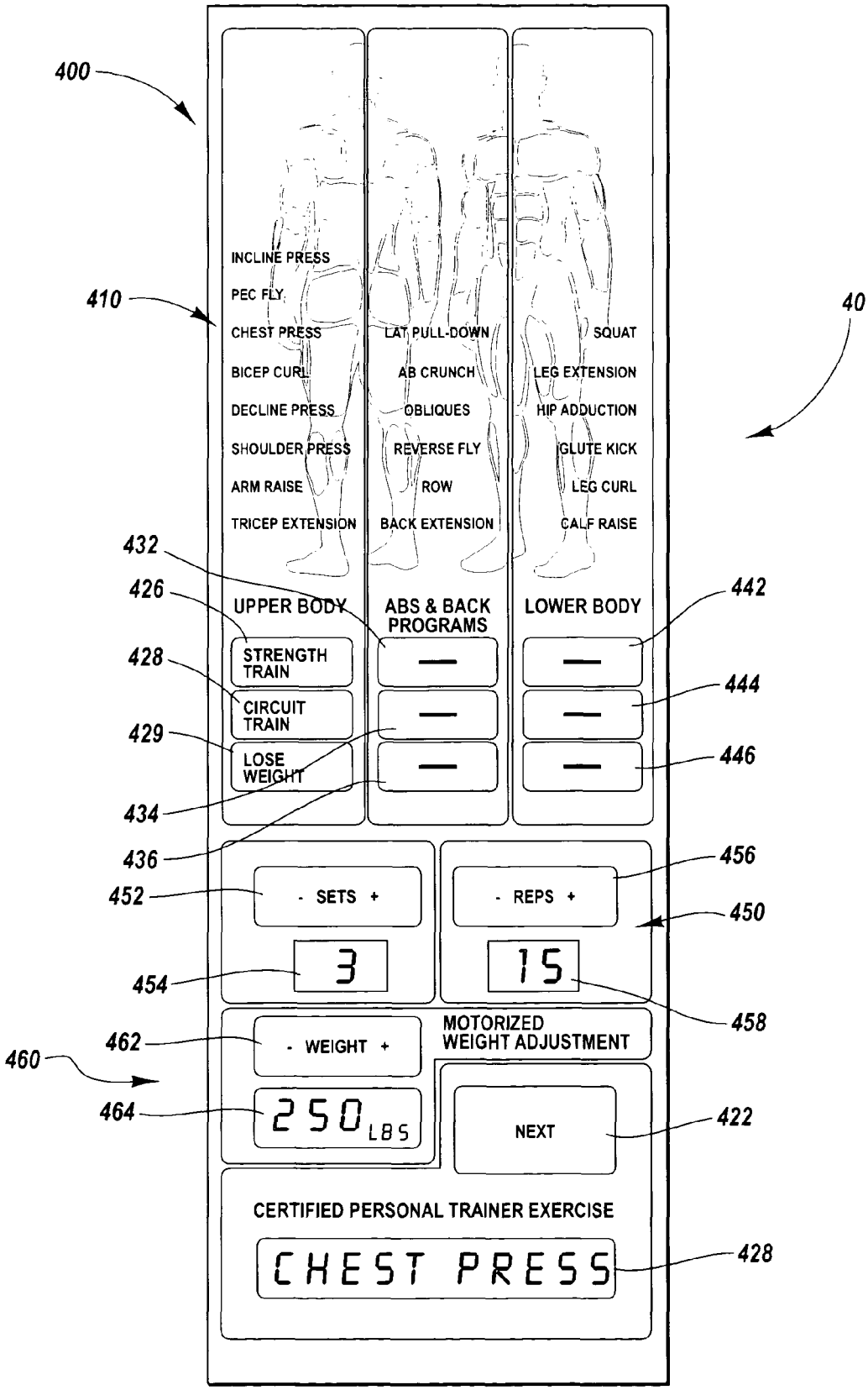
FIG. 8 illustrates the automatic weight selector control of the exercise machine of FIG. 1 according to one aspect of the present invention.

FIG. 8 shows an electronic weight selector control 40 according to one aspect of the present invention. Electronic weight selector control 40 is coupled to upright component support member 18. Electronic weight selector control 40 allows a user to select an amount of resistance to be utilized in exercise. In the illustrated embodiment, electronic weight selector control includes a control panel 400. Control panel 400 includes exercise indicia 410, personal trainer selectors 420, set/rep selectors 450, and weight selector 460.

Exercise indicia 410 provides a list of recommended exercise routines that can be utilized by the user in connection with exercise apparatus 1. In the illustrated embodiment, exercise indicia 410 are arranged to allow a use to identify exercise routines adapted to benefit certain muscle groups. For example, upper body exercises include an incline press, a pectoral fly, a chest press, a bicep curl, a decline press, a shoulder press, an arm raise, and a tricep extension. Abs and back programs include a lat pull down, abdominal crunch, obliques, reverse fly, row, and back extension. Lower body exercises include a squat, leg extension, hip adduction, glute kick, leg curl, and calf raise.

As will be appreciated by those skilled in the art, a variety of types and configurations of exercises can be utilized without departing from the scope and spirit of the present invention. For example, in one embodiment, a larger or smaller number of exercises are included. In an alternative embodiment, the exercise indicia can include color coded panels to facilitate coordination of exercise routines for certain muscle groups.

Personal trainer selectors 420 allow a user to select preprogrammed exercise routines adapted to provide physiological benefits corresponding with traditional types of personal training programs. In the illustrated embodiment, personal trainer selectors 420 include a next exercise button 422, a personal trainer exercise display 424, and selector buttons 426 through 446. Next exercise button 422 allows a user to begin a new exercise routine or skip an exercise routine altogether. Personal trainer exercise display 424 indicates the exercise routine to be undertaken as a part of the personal training program. In the illustrated embodiment, a chest press exercise routine is indicated as the exercise routine to be undertaken by the user.

Selector buttons 426-446 allow a user to select a preprogrammed exercise routine to be undertaken. Selector button 426 allows a user to select an upper body strength training routine. Selector button 428 allows a user to select an upper body circuit training routine. Selector button 429 allows a user to select an upper body weight loss routine. Selector button 437 allows a user to select an abs and back strength training routine. Selector button 434 allows a user to select an abs and back circuit training routine. Selector buttons 436 allows a user to select an abs and back weight loss routine. Selector button 442 allows a user to select a lower body strength training routine. Selector button 444 corresponds with the lower body circuit training routine. Selector button 446 allows a user to select a lower body weight loss routine.

To begin a preprogrammed exercise routine, the user selects the preprogrammed exercise routine by depressing or otherwise actuating the appropriate selector button. According one embodiment of the present invention, the preprogrammed exercise routine automatically indicates the exercise routine to be undertaken, the number of sets and reps to be conducted, and the amount of resistance in to be utilized. In one embodiment, the user may change the number of sets, reps and/or the resistance to be utilized in the routine. As the user undertakes the exercise routine, the exercise apparatus 1 automatically detects the number of sets and reps conducted and changes the remaining number of sets and reps to be performed. Once the exercise routine is completed, the next exercise routine to be undertaken is displayed on the personal trainer exercise display 424.

Sets/reps selectors 450 allow a user to select and/or change the number of sets and reps to be undertaken. Set/reps selectors 450 include sets selector button 452, sets numeric display 454, reps selector button 456, and reps numeric display 458. Sets selector button allows the user to increase or decrease the number of sets to be undertaken in a given exercise routine. Sets numeric display 454 indicates the number of sets to be undertaken by the user. Reps selector button 456 allows the user to increase or decrease the number of reps to be undertaken in each set of an exercise routine. Reps numeric display indicates the number of reps to be undertaken before completion of a given set of the exercise routine.

Weight selector 460 allows the user to identify and select a given amount of resistance to be utilized in an exercise routine. Weight selector button 460 includes a weight selector button 462, and a weight display 464. Weight selector button 462 allows the user to increase or decrease the amount of weight to be utilized in a given exercise routine. Weight display 464 allows a user to identify the amount of resistance/weight set by the machine and to be utilized in the exercise routine. Weight selector display 460 allows a user to quickly and efficiently select and/or change the amount of resistance to be utilized in the exercise.

The increments and speed with which the resistance is changed can vary based on the speed with which the user depresses the weight selector button 462. In one embodiment, when the user holds down plus or minus portion of the weight selector button 462, the amount of resistance quickly changes. As the user utilizes distinct depressions of the weight selector button 462, the weight change occurs more gradually and in smaller increments. This allows a user to quickly and accurately select a highly specific weight increment. For example, in one embodiment, the weight can be changed in approximately one pound increments as the user approximates the desired weight to be utilized.

Figure 9:
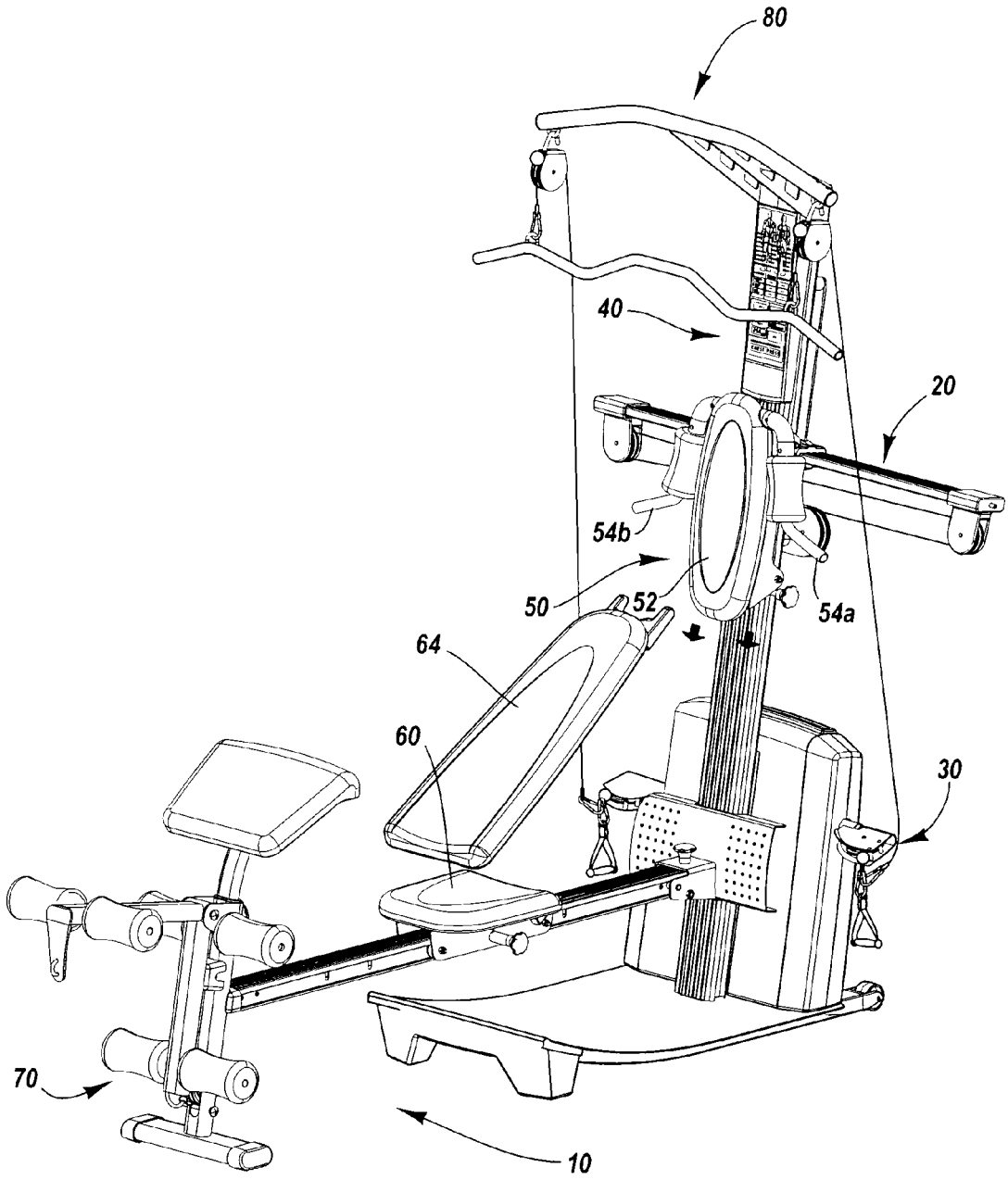
FIG. 9 is a perspective view of the exercise machine of FIG. 1 illustrating the squat apparatus according to one aspect of the present invention.

FIG. 9 is a perspective view of exercise apparatus 1 illustrating a squat apparatus 50. Squat apparatus 50 is slideably coupled to upright component support member 18. A user conducts a squat routine by raising and lowering squat apparatus 50. Squat apparatus 50 includes cushioning member 52 and hand grip assemblies 54*a, b*. Cushioning member contacts a user's back during exercise while providing support and cushioning to forces exerted by the user against squat apparatus 50. Hand grip assemblies 54*a, b* are grasped by the user during exercise to raise and lower squat apparatus 50.

In preparation for conducting a squat exercise routine, back support 64 is disconnected from seat member 62 and removed from horizontal support member 14. This allows the user to straddle horizontal support member 14 with the user's feet being positioned on support base 16. The user then raises and lowers squat apparatus 50 by grasping hand grip assemblies 54*a, b* while the user's back contacts cushioning member 52. As will be appreciated by those skilled in the art, a variety of types and configurations of squat apparatuses can be utilized to conduct a squat routine without departing from the scope and spirit of the present invention. The configuration and angle of squat apparatus 50 on upright component support member 18 ensures smooth and predictable movement during a squat routine. Additionally, the angle is adapted to minimize impact on the user's joints.

Figure 10:
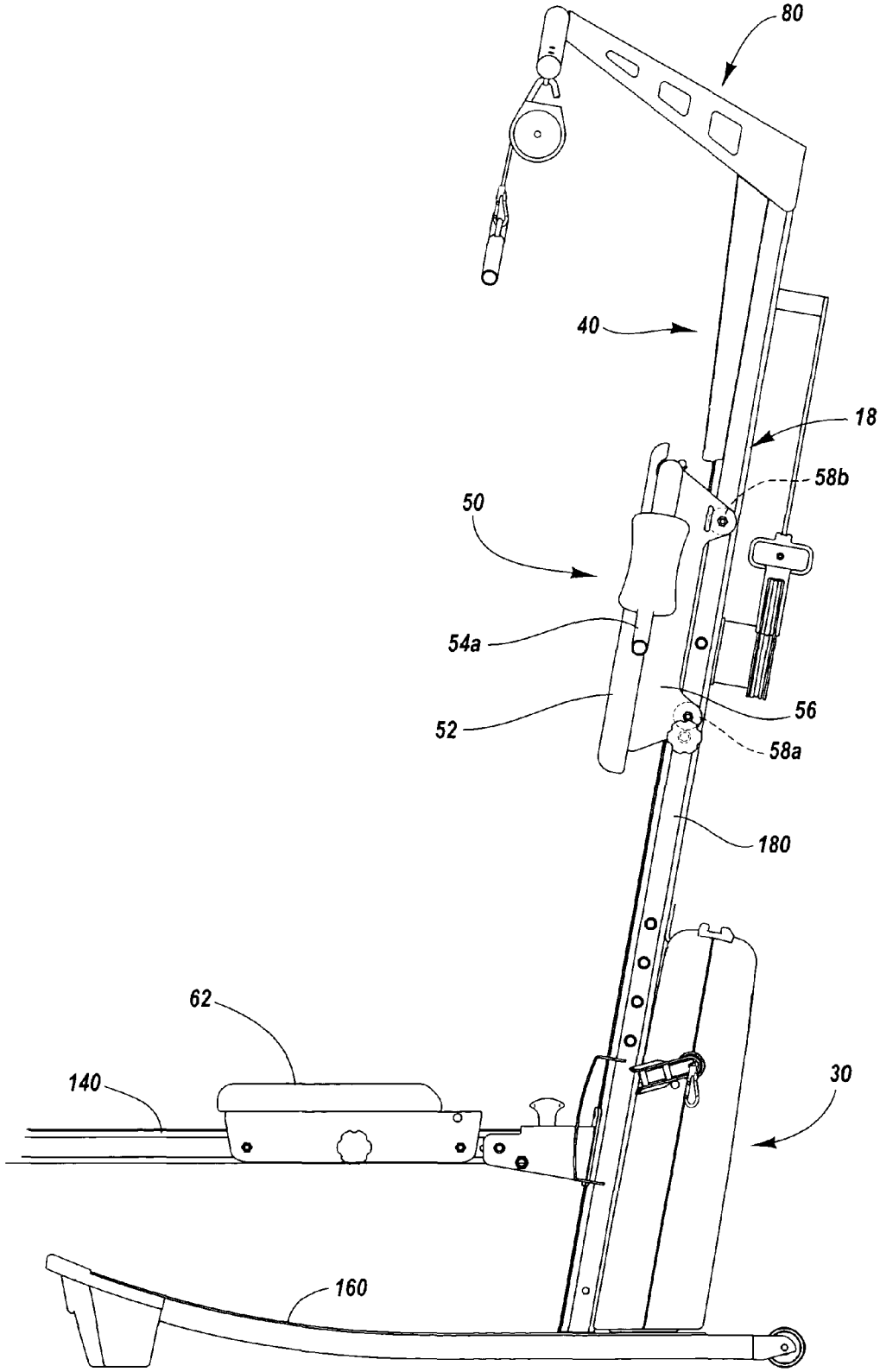
FIG. 10 is a perspective view of the exercise machine of FIG. 1 illustrating the operation of squat apparatus and roller track of upright component support member according to one aspect of the present invention.

FIG. 10 illustrates an upright component support member 18 and squat apparatus 50 in greater detail. In the illustrated embodiment, upright component support member 18 includes a roller track 180. Another roller track 180 is positioned on the opposite side of upright component support member 18. Squat apparatus 50 includes a support frame 56 and rollers 58*a-d*. Support frame 56 provides a foundation on which cushioning member 52, hand grip assemblies 54*a, b*, and rollers 58*a-d* are affixed. Rollers 58*a-d* are positioned within roller track 180. The configuration of rollers 58*a-d* and roller track 180 allows smooth and consistent sliding movement of squat apparatus 50 relative to upright component support member 18.

In the illustrated embodiment roller track 180 is formed from an extruded aluminum material integrally coupled to upright component support member 18. As will be appreciated by those skilled in the art, a variety of types and configurations of mechanisms for slidably coupling the squat apparatus to upright component support member 18 may be utilized without departing from the scope and spirit of the present invention.

Figure 11:
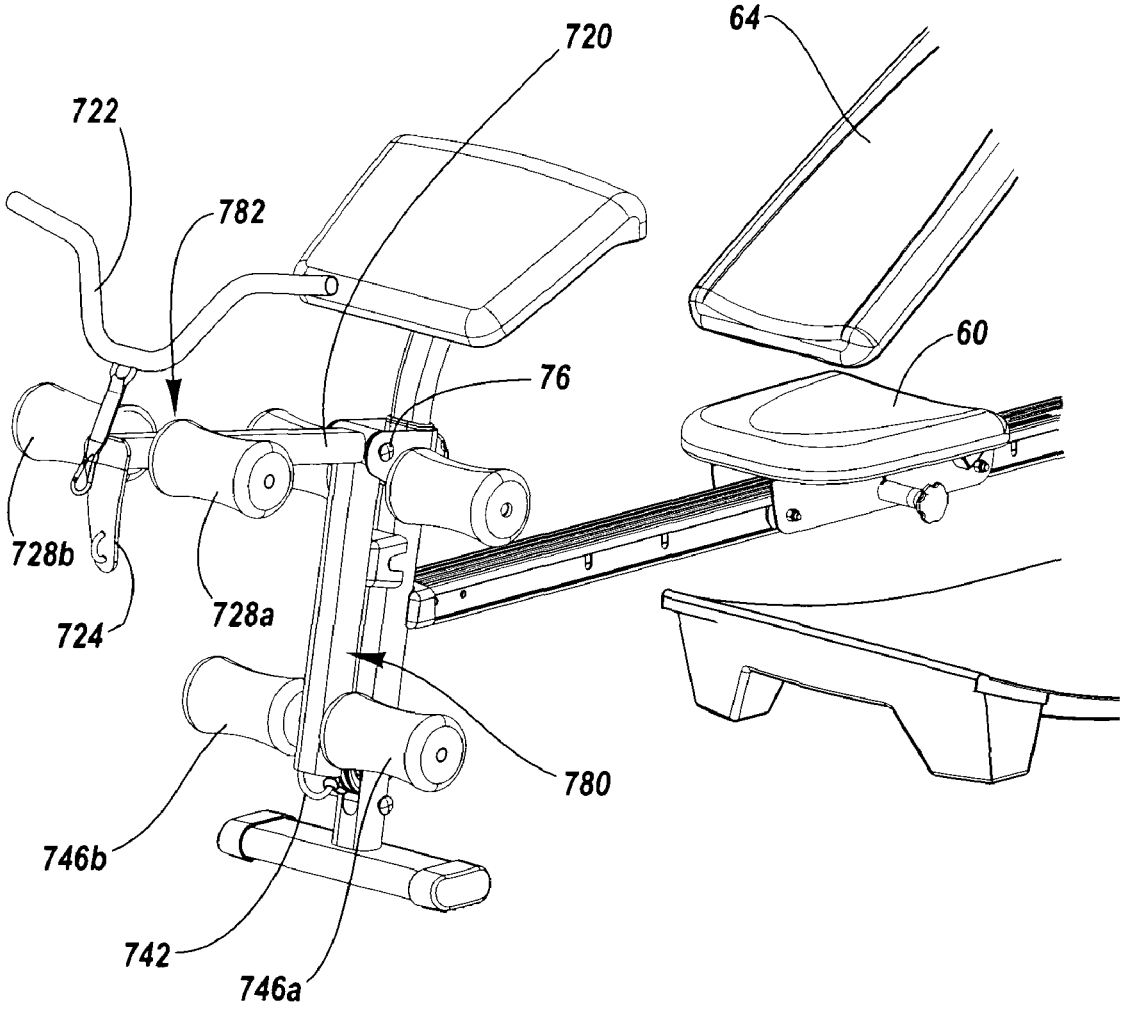
FIG. 11 illustrates the bicep/quad exerciser of the exercise machine of FIG. 1 according to one aspect of the present invention.

With reference now to FIG. 11, there is shown a bicep/quad exerciser 70 utilized in connection with the resilient elongate rod 22. Bicep/quad exerciser includes a quad portion 74, a bicep portion 72, and pivot 76. Quad portion 76 allows a user to conduct exercise routines relating to the quadriceps and other leg muscles. Biceps portion 72 allows the user to conduct exercise routines related to the biceps and other muscles of the user's body. Pivot 76 provides a point of rotation for allowing movement of bicep/quadricep exerciser 70 during exercise routines.

In the illustrated embodiment, bicep portion 72 includes a support arm 720 a hand grip bar 722, a coupler 724, and cushion members 728*a, b*. Hand grip bar 722 includes the main support structure of bicep portion 72. Hand grip bar 722 provides a foundation on which other components of bicep portion 72 are positioned. Hand grip bar 722 is adapted to be linked to support arm 720. Hand grip bar is adapted to be grasped by the user during bicep curls exercise routines and/or other exercise routines to be undertaken by the user. Coupler 724 couples to support arm 720 to hand grip bar 722. In the illustrated embodiment, coupler 724 includes a rigid member positioned at a transverse angle to support arm 720. Coupler 724 includes a hook 726 which is coupled to hand grip bar 722 to secure hand grip bar 722 to support arm 720.

Cushion members 728*a, b* are coupled near one end of support arm 720. Cushion members 728*a, b* are adapted to provide protection and/or a mechanism for allowing a user to exercise utilizing bicep portion 72. As will be appreciated by those skilled in the art a variety of types and configurations of bicep portion 72 can be utilized without departing from the scope and spirit of the present invention. For example in one embodiment, hand grip bar 722 is integrally coupled to support arm 720. In an alternative embodiment, a separate hand grip bar 722 is selectably coupled directly to support arm 720.

Quad portion 74 allows a user to exercise leg and/or other muscles. Quad portion 74 allows a user to exercise the user's quadricep muscles. Quad portion 74 is coupled directly to bicep portion 72. Quad portion 74 includes a support member 740, a hook 742, and cushions 746*a, b*. In the illustrated embodiment, support member 740 includes the main support structure for quad portion 74. Support member 740 is the structure to which other components of quad portion 74 are coupled.

Hook 742 is coupled to the end of support member 740. Hook 742 is adapted to be coupled to a cable which is then coupled to one or both of the ends of cable 342 of cable and pulley system 340. By being coupled to cable 342, hook 742 enables a user to utilize resistance from resilient elongate rod 22 to conduct exercises utilizing bicep/quad exercisers. Cushions 746*a, b* are coupled at or near the end of support member 740. Cushions 746*a, b* are adapted to engage a user's foot, shin and/or other portion of the body to allow the user to conduct exercises such as quadriceps exercise routines.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise machine, comprising:

a support frame having a support base configured to provide stability to the exercise machine in order to provide a stable exercise environment;

a single resilient elongate rod linked to the support frame, the resilient elongate rod configured to provide resistance for use in exercise; and a variable resistance system linked to the single resilient elongate rod, the variable resistance system being configured to vary a mechanical advantage usable to flex the resilient elongate rod to vary the amount of resistance presented by the resilient elongate rod for use in exercise, the variable resistance system comprising a cable and pulley system.

2. The exercise machine of claim 1, wherein the support frame further includes an upright support member.

3. The exercise machine of claim 2, wherein the single resilient elongate rod is coupled to the upright support member of the support frame.

4. The exercise machine of claim 1, wherein the single resilient elongate rod includes a first end, a second end, and a center portion, the first end, the second end, and the center portion move during exercise.

5. The exercise machine of claim 1, wherein the variable resistance system includes a lever arm.

6. The exercise machine of claim 5, wherein the amount of mechanical advantage provided by the lever arm can be varied to change the amount of resistance needed to flex the resilient elongate rod.

7. The exercise machine of claim 6, further comprising a lever arm length regulator adapted to change the effective length of the lever arm to vary the mechanical advantage provided by the lever arm.

8. The exercise machine of claim 7, further comprising a lead screw coupled to the lever arm length regulator to change the effective length of the lever arm.

9. The exercise machine of claim 8, wherein the lead screw is automatically adjustable by the user utilizing an electronic weight selector control that operates in connection with the variable resistance system.

10. An exercise machine, comprising:

a support frame having a support base configured to provide stability to the exercise machine in order to provide a stable exercise environment;

at least one resilient elongate member having a first end, a second end, and an intermediate portion, wherein the intermediate portion is linked to the support frame; and a cable and pulley system coupled to the support frame and the at least one resilient elongate member, the cable and pulley system having at least one cable adapted to be moved by the user, wherein movement of the at least one cable causes movement of the first end, the second end, and the intermediate portion of the at least one resilient elongate member.

11. The exercise machine of claim 10, wherein the cable and pulley system includes a plurality of pulleys.

12. The exercise machine of claim 11, wherein the cable and pulley system provides a compound effect allowing the user to displace at least a first end of the cable and pulley system a greater amount than the ends of the resilient elongate rod are displaced.

13. The exercise machine of claim 12, wherein the compound effect of the cable and pulley system allows the user to displace both ends of the cable a greater amount than the ends of the resilient elongate rod are displaced.

14. The exercise machine of claim 10, wherein a single cable is routed through the plurality of pulleys such that a user can displace at least a first end of the cable during exercise.

15. The exercise machine of claim 10, wherein the cable and pulley system is included as part of a variable resistance system.

16. The exercise machine of claim 15, wherein the resilient elongate rod is included as part of a resistance assembly.

17. The exercise machine of claim 16, wherein the resistance assembly includes a secondary cable and pulley system.

18. The exercise machine of claim 17, wherein the cable and pulley system of the resistance assembly cooperates with the cable and pulley system of the resistance assembly to allow a user to exercise utilizing resistance from the resilient elongate rod.

19. An exercise machine, comprising:

a support frame having a support base configured to provide stability to the exercise machine in order to provide a stable exercise environment;

a single resilient elongate rod positioned adjacent to the support frame, the resilient elongate rod configured to flex and provide a resistance for use in exercise;

a variable resistance system linked to the resilient elongate rod, the variable resistance system comprising:

a cable and pulley system, and an automatic resistance adjustment mechanism linked to the cable and pulley system, the automatic resistance adjustment mechanism having a lead screw and a lead screw motor assembly; and a resistance selector system cooperating with the single resilient elongate rod and the variable resistance system, the resistance selector system being configured to vary a mechanical advantage usable to flex the resilient elongate rod to vary the amount of resistance provided by the single resilient elongate rod during exercise.

20. The exercise machine of claim 19, wherein the resistance selector system comprises an electronic resistance selector system.

21. The exercise machine of claim 20, wherein the electronic resistance selector system includes a variable resistance system and an electronic weight selector control.

22. The exercise machine of claim 21, wherein the electronic weight selector control allows a user to automatically select the amount of resistance to be utilized during an exercise routine.

23. The exercise machine of claim 22, wherein the electronic weight selector control includes a plurality of selector buttons for changing various parameters of the exercise machine.

24. The exercise machine of claim 23, wherein the plurality of weight selector buttons are adapted to change the amount resistance to be utilized during an exercise machine.

25. The exercise machine of claim 21, wherein the electronic weight selector control includes one or more preprogrammed exercise routines.

26. The exercise machine of claim 25, wherein the one or more preprogrammed exercise routines automatically identify a series of exercises to be conducted by the user.

27. The exercise machine of claim 25, wherein the one or more preprogrammed exercise routines automatically selects the number of sets and repetitions to be performed for each exercise to be conducted by the user.

28. The exercise machine of claim 25, wherein the exercise machine automatically detects the number of sets and repetitions conducted by the user.

29. The exercise machine of claim 28, wherein the one or more preprogrammed exercise routines automatically selects the amount of resistance for each exercise to be conducted by the user.

30. The exercise machine of claim 29, wherein the user can modify various parameters related to the preprogrammed exercise routines including the numbers of sets, number of repetitions, resistance to be utilized, and the exercise to be performed.

31. An exercise machine, comprising:

a support frame having an upright support member;

at least one resilient elongate rod positioned adjacent to the support frame;

a cable and pulley system coupled to the support frame and the at least one resilient elongate member, the cable and pulley system having at least one cable adapted to be moved by the user;

a squat apparatus rollably coupled to the upright support member of the support frame, the squat apparatus being coupled to the cable and pulley system to utilize resistance from the at least one resilient elongate rod.

32. The exercise machine of claim 31, wherein the upright support member includes one or more tracks integrally formed therein.

33. The exercise machine of claim 32 wherein the squat apparatus includes a plurality of rollers positioned in the one or more tracks of the upright support member.

34. The exercise machine of claim 31, further comprising an electronic resistance selector system cooperating with the at least one resilient elongate rod, the electronic resistance selector system being configured to vary the amount of resistance provided by the resilient elongate rod during exercise.

35. An exercise machine, comprising:

a support frame;

a seat member movably connected to the support frame, the seat member being configured to enable a user to rest thereon;

at least one resilient elongate rod supported by the support frame, the at least one resilient elongate rod being movable relative to the support frame such that no portion of the at least one resilient elongate rod is fixed in relation to the support frame; and a cable and pulley system cooperating with the at least one resilient elongate rod, said mechanism being adapted to allow a user to exercise utilizing the resistance from the at least one resilient elongate rod to perform exercise.

36. The exercise machine of claim 35, wherein a cable of the cable and pulley system is linked to the ends of the at least one resilient elongate rod to utilize resistance from the at least one resilient elongate rod.

37. The exercise machine of claim 36, wherein the center portion of the ends of the at least one resilient elongate rod move closer together when the at least one resilient elongate rod undergoes flexing.

38. The exercise machine of claim 35, further comprising a guide mounted to the support frame, the guide being adapted to minimize lateral movement of the at least one resilient elongate rod.

39. The exercise machine of claim 38, wherein the guide is circumscribed by the center portion of the at least one resilient elongate rod.

40. An exercise machine, comprising:

a support frame having a support base configured to provide stability to the exercise machine in order to provide a stable exercise environment;

at least one resilient elongate rod linked to the support frame, the resilient elongate rod configured to provide resistance for use in exercise;

a cable and pulley system linked to the resilient elongate rod; and a variable resistance system linked to the cable and pulley system to utilize resistance from the resilient elongate rod to provide a variable amount of resistance for use in exercise.

41. An exercise machine, comprising:

a support frame;

at least one resilient elongate rod linked to the support frame, the at least one resilient elongate rod configured to provide resistance for use in exercise;

an electronic variable resistance system linked to the resilient elongate rod and being configured to utilize the resilient elongate rod to provide a variable amount of resistance for use in exercise, the electronic variable resistance system comprising:

an automatic resistance adjustment mechanism having a lead screw, a lead screw motor assembly, a lever arm, and a lever arm regulator, the automatic resistance adjustment mechanism configured to regulate an amount of resistance required to displace the at least one resilient elongate rod.

42. The exercise machine of claim 41, wherein the support frame includes an upright support member.

43. The exercise machine of claim 42, wherein the resilient elongate rod is coupled to the upright support member of the support frame.

44. The exercise machine of claim 41, further comprising a cable and pulley system coupled between the resilient elongate rod and the electronic variable resistance system includes a cable and pulley system.

45. The exercise machine of claim 44, wherein the lever arm of the variable resistance system is coupled to the cable and pulley system.

46. The exercise machine of claim 45, wherein the amount of mechanical advantage provided by the lever arm can be varied to change the force needed to flex the resilient elongate rod.

47. The exercise machine of claim 46, wherein the lever arm length regulator is adapted to change the effective length of the lever arm to vary the mechanical advantage provided by the lever arm.

48. The exercise machine of claim 47, wherein the lead screw is coupled to the lever arm length regulator to change the effective length of the lever arm.

49. The exercise machine of claim 48, wherein the lead screw is automatically adjustable by the user utilizing the electronic variable resistance system.

50. The exercise machine of claim 41, wherein the electronic variable resistance system allows a user to automatically select the amount of resistance to be utilized during an exercise routine.

51. The exercise machine of claim 41, wherein the electronic variable resistance system includes one or more preprogrammed exercise routines.

52. The exercise machine of claim 51, wherein the electronic variable resistance system automatically identifies a series of exercises to be conducted by the user.

53. The exercise machine of claim 51, wherein the electronic variable resistance system automatically selects the number of sets and repetitions to be performed for each exercise to be conducted by the user.

54. The exercise machine of claim 53, wherein the electronic variable resistance system automatically detects the number of sets and repetitions performed by the user.

55. The exercise machine of claim 51, wherein the electronic variable resistance system automatically selects the amount of resistance for each exercise to be conducted by the user.

56. The exercise machine of claim 51, wherein the electronic variable resistance system allows the user to modify various parameters related to the preprogrammed exercise routines, including the numbers of sets, number of repetitions, resistance to be utilized, and the exercise to be performed.

57. The exercise machine of claim 56, wherein the electronic variable resistance system includes a plurality of selector buttons for changing various parameters of the exercise machine.

58. The exercise machine of claim 57, wherein the plurality of selector buttons are adapted to change the amount resistance to be utilized during an exercise machine.

* * * * *

UNITED STATES PATENT AND TRADEMARK OFFICE

CERTIFICATE OF CORRECTION

PATENT NO. : 7,537,552 B2
APPLICATION NO. : 10/647729
DATED : May 26, 2009
INVENTOR(S) : Dalebout et al.

It is certified that error appears in the above-identified patent and that said Letters Patent is hereby corrected as shown below:

Delete the title page and substitute therefore the attached title page showing corrected illustrative figure.

Drawings

Sheet 1, please replace the current drawing of FIG. 1 with the figure depicted below in which "exercise machine 1" has been labeled correctly.

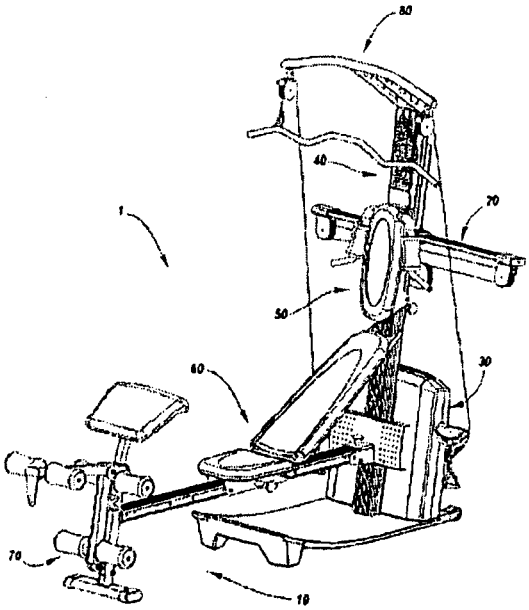

*Fig. 1*

Sheet 10, please replace the current drawing of FIG. 8 with the figure depicted below in which "personal trainer selectors 420" and "personal trainer exercise display 424" have been labeled correctly.
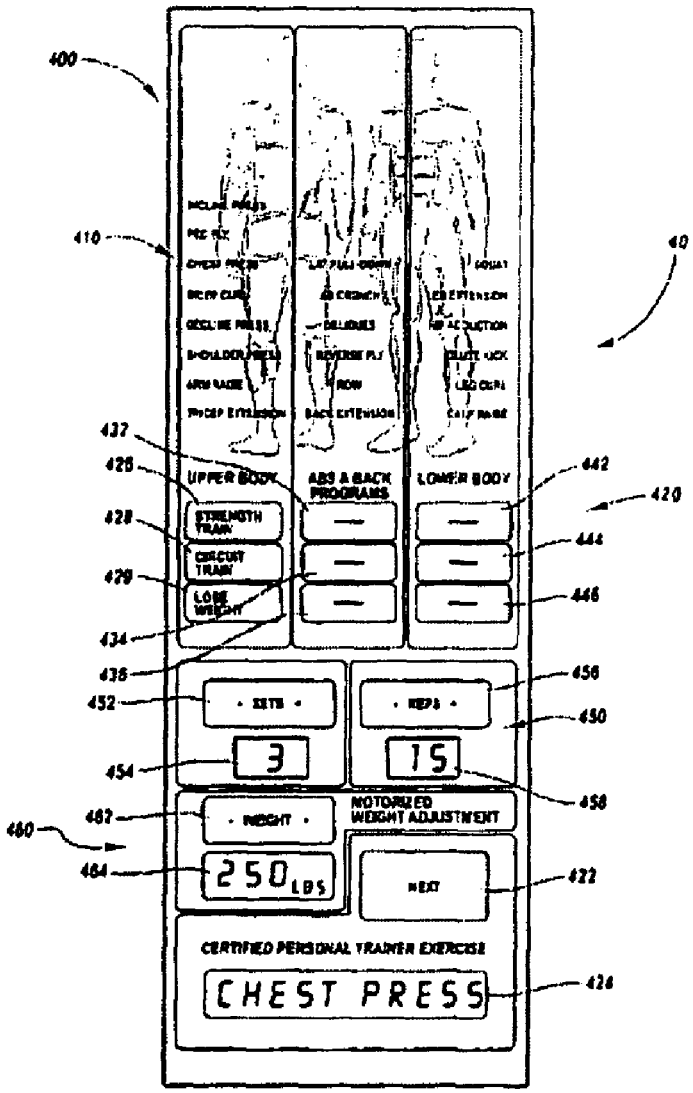

Sheet 13, please replace the current drawing of FIG. 11 with the figure depicted below in which "bicep portion 72" "quad portion 74" "hook 726" and "support member 740" have been labeled correctly.
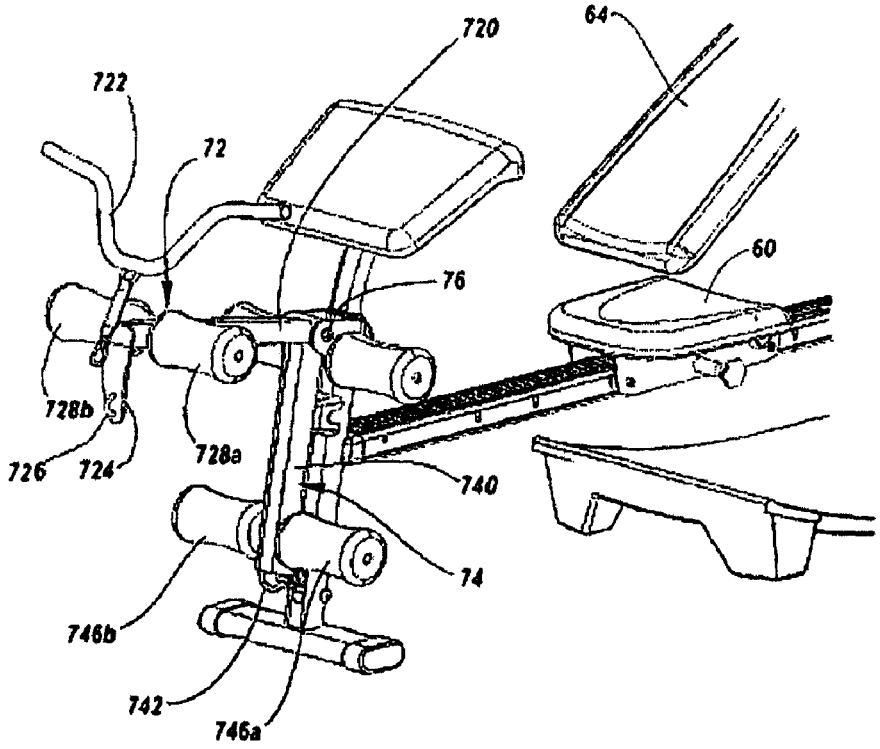

Column 5
Line 50, change "provide" to --provides--

Column 6
Line 9, change "exerciser" to --exercise--
Line 63, change "86" to --86a--

Column 10
Line 64, change "angel" to --angle--

Column 12
Line 25, change "202" to --302--

Column 13
Line 51, change "use" to --user--

Column 14
Line 31, change "one" to --to one--

Column 15
Line 61, change "Quad portion 76" to --Quad portion 74--

Column 19
Line 36, change "move" to --moves--

Signed and Sealed this

Ninth Day of March, 2010

David J. Kappos
*Director of the United States Patent and Trademark Office*

(12) United States Patent
Dalebout et al.

(10) Patent No.: US 7,537,552 B2
(45) **Date of Patent: *May 26, 2009**

(54) EXERCISE DEVICE WITH CENTRALLY MOUNTED RESISTANCE ROD AND AUTOMATIC WEIGHT SELECTOR APPARATUS

(75) Inventors: William T. Dalebout, North Logan, UT (US); Michael Olson, Logan, UT (US)

(73) Assignee: Icon IP, Inc. (State of Delaware), Logan, UT (US)

( * ) Notice: Subject to any disclaimer, the term of this patent is extended or adjusted under 35 U.S.C. 154(b) by 743 days.

This patent is subject to a terminal disclaimer.

(21) Appl. No.: 10/647,729

(22) Filed: Aug. 25, 2003

(65) Prior Publication Data

US 2005/0049121 A1 Mar. 3, 2005

(51) Int. Cl.
*A63B 21/04* (2006.01)
*A63B 21/02* (2006.01)

(52) U.S. Cl. ..... 482/129; 482/130; 482/121

(58) Field of Classification Search ..... 482/129–130, 482/139, 121–123, 100–103
See application file for complete search history.

(56) References Cited

U.S. PATENT DOCUMENTS

| | | | | |
|---|---|---|---|---|
| 9,695 | A | 5/1853 | Hinsdale | |
| 192,338 | A | 6/1877 | Marshall | |
| 325,435 | A | 9/1885 | North | 186/22 |
| 428,912 | A | 5/1890 | Holmes | |
| 484,352 | A | 10/1892 | Ayton | |
| 588,350 | A | 8/1897 | Perkins | |
| 610,716 | A | 9/1898 | Marshall | |
| 685,788 | A | 11/1901 | McFadden | |
| 754,992 | A | 3/1904 | Grabner | |
| 807,670 | A | 12/1905 | Grabner | |
| 852,193 | A | 4/1907 | McMillan | |

(Continued)

FOREIGN PATENT DOCUMENTS

| | | |
|---|---|---|
| DE | 23 46 105 | 3/1975 |

(Continued)

OTHER PUBLICATIONS

Breitbart Muscle Builder Apparatus, *Breitbard Pupils Say it with Muscles*!, May 4, 1929 (3 pages).

(Continued)

*Primary Examiner*—Fenn C Mathew
(74) *Attorney, Agent, or Firm*—Workman Nydegger

(57) ABSTRACT

An exercise apparatus with a single resistant rod configured to provide resistance for use in exercise and an electronic weight selector mechanism for use with a resistance rod having a variable resistance system and an electronic weight selector control. The variable resistance system includes a cable and pulley system that compounds the force exerted by the user on the cable and pulley system allowing the user a greater extension length per unit length the resistance rod is displaced. The variable resistance system includes a lever arm having an adjustable effective length to change the amount of resistance by changing the mechanical advantage provided by the lever arm. The electronic weight selector control including program exercise routines which assist the user in exercise by providing desired patterns, amounts of resistance, numbers of sets and repetitions, and combinations of exercises to be performed.

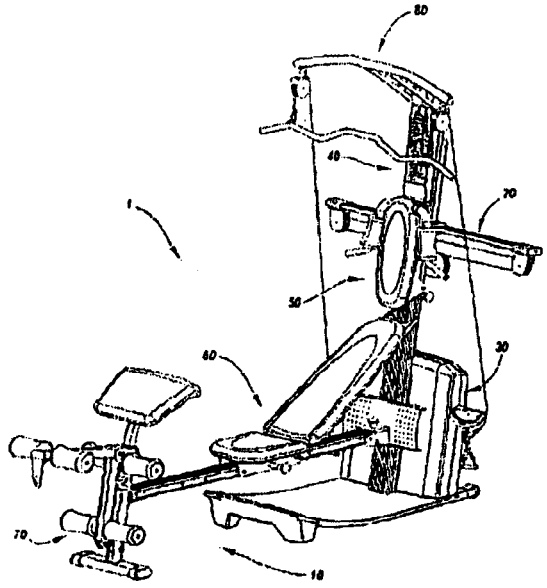

58 Claims, 13 Drawing Sheets